US009767811B2

(12) United States Patent
Lang et al.

(10) Patent No.: US 9,767,811 B2
(45) Date of Patent: *Sep. 19, 2017

(54) DEVICE AND METHOD FOR POSTPROCESSING A DECODED MULTI-CHANNEL AUDIO SIGNAL OR A DECODED STEREO SIGNAL

(71) Applicant: Huawei Technologies Co., Ltd., Shenzhen, Guangdong (CN)

(72) Inventors: Yue Lang, Munich (DE); David Virette, Munich (DE); Lei Miao, Beijing (CN); Wenhai Wu, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 814 days.

This patent is subject to a terminal disclaimer.

(21) Appl. No.: 13/852,554

(22) Filed: Mar. 28, 2013

(65) Prior Publication Data

US 2013/0279702 A1 Oct. 24, 2013

Related U.S. Application Data

(63) Continuation of application No. PCT/CN2010/077388, filed on Sep. 28, 2010.

(51) Int. Cl.
*G10L 19/008* (2013.01)
*G10L 21/0364* (2013.01)

(52) U.S. Cl.
CPC ..... *G10L 19/008* (2013.01); *G10L 21/0364* (2013.01)

(58) Field of Classification Search
CPC G10L 19/008; G10L 21/0364; H04S 2420/03
See application file for complete search history.

(56) References Cited

U.S. PATENT DOCUMENTS 5,974,380 A 10/1999 Smyth et al.
2006/0085200 A1* 4/2006 Allamanche ..... H04S 3/02 704/500

(Continued)

FOREIGN PATENT DOCUMENTS

CN 1926607 A 3/2007
CN 1947172 A 4/2007

(Continued)

OTHER PUBLICATIONS

International Search Report dated Jun. 30, 2011 in connection with International Patent Application No. PCT/CN2010/077388.

(Continued)

*Primary Examiner* — Ping Lee

(57) ABSTRACT

According to the invention, a device for post-processing at least one channel signal of a plurality of channel signals of a multi-channel signal is described, the at least one channel signal being generated from a decoded downmix signal by a low-bit-rate audio coding/decoding system, the device comprising: a receiver for receiving the at least one channel signal generated from the decoded downmix signal, a time envelope of the decoded downmix signal, an interchannel time difference between the channel signal and the downmix signal, and a classification indication indicating a transient type of the downmix signal; and a post-processor for post-processing the at least one channel signal based on the time envelope of the decoded downmix signal weighted by a respective weighting factor and in dependence on the classification indication and the interchannel time difference.

13 Claims, 17 Drawing Sheets

(56) References Cited

U.S. PATENT DOCUMENTS

| | | | | |
|---|---|---|---|---|
| 2006/0147048 | A1* | 7/2006 | Breebaart | G10L 19/008 381/23 |
| 2006/0190247 | A1 | 8/2006 | Lindblom | |
| 2007/0140499 | A1* | 6/2007 | Davis | G10L 19/008 381/23 |
| 2007/0183601 | A1* | 8/2007 | Van Loon | G10L 19/008 381/1 |
| 2007/0194952 | A1 | 8/2007 | Breebaart et al. | |
| 2007/0236858 | A1 | 10/2007 | Disch et al. | |
| 2008/0031463 | A1 | 2/2008 | Davis | |
| 2008/0199014 | A1 | 8/2008 | Kurniawati et al. | |
| 2009/0319282 | A1 | 12/2009 | Allamanche et al. | |
| 2011/0091046 | A1 | 4/2011 | Villemoes | |
| 2013/0173273 | A1* | 7/2013 | Kuntz | G10L 19/008 704/500 |

FOREIGN PATENT DOCUMENTS

| | | | |
|---|---|---|---|
| CN | 101044794 | A | 9/2007 |
| CN | 101120615 | A | 2/2008 |
| CN | 101460997 | A | 6/2009 |
| JP | 2000501846 | A | 2/2000 |
| JP | 2007526522 | A | 9/2007 |
| JP | 2007531913 | A | 11/2007 |
| JP | 2008517334 | A | 5/2008 |
| JP | 2009531724 | A | 9/2009 |
| WO | WO 02/093560 | A1 | 11/2002 |

OTHER PUBLICATIONS

Written Opinion of the International Searching Authority dated Jun. 30, 2011 in connection with International Patent Application No. PCT/CN2010/077388.

Brett Crockett, "Improved Transient Pre-Noise Performance of Low Bit Rate Audio Coders Using Time Scaling Synthesis", Audio Engineering Society, Convention Paper 6184, Oct. 28-31, 2004, 10 pages.

Erik Schuijers, et al., "Advances in Parametric Coding for High-Quality Audio", Audio Engineering Society, Convention Paper 5852, Mar. 22-25, 2003, 11 pages.

J. Herre, et al., "The Reference Model Architecture for MPEG Spatial Audio Coding", Audio Engineering Society Convention Paper 6447, May 28-31, 2005, 13 pages.

* cited by examiner

Left channel signal

Right channel signal

DEVICE AND METHOD FOR POSTPROCESSING A DECODED MULTI-CHANNEL AUDIO SIGNAL OR A DECODED STEREO SIGNAL

CROSS-REFERENCE TO RELATED APPLICATIONS

This application is a continuation of International Application No. PCT/CN2010/077388, filed on Sep. 28, 2010, which is hereby incorporated by reference in their entireties.

TECHNICAL FIELD

The present invention relates to post-processing a decoded multi-channel audio signal and to post-processing a decoded stereo audio signal, the post-processing of the stereo audio signal representing a specific case of post-processing a decoded multi-channel audio signal.

BACKGROUND

In a conventional speech codec, classification of speech signals is often performed to improve the coding efficiency of the speech signals. At the decoder side, different types of signal processing tools are used depending on the transmitted classification of the speech signal.

One classification is to distinguish between normal speech signals and transient speech signals. Transient signals are short duration signals and are characterized by a fast change in signal power and amplitude. The transient signals are, e.g., distinguished from "normal" or non-transient signals, e.g. signals with a longer duration and/or only minor changes in signal power and amplitude. This kind of classification is not limited to speech signals but is applicable to audio signals in general.

For transient signals, a common method is to extract the time envelope of the input signal in the encoder, transmit it as side information to the decoder and apply it in the decoder as a post-processing.

For stereo signals, such a kind of post-processing is often necessary, but there are conventionally not enough bits to encode the time envelope of both channels.

In the prior art (E. Schuijers, W. Oomen, B. den Brinker, and J. Breebaart, "Advances in parametric coding for high-quality audio," in Preprint 114th Cony. Aud. Eng. Soc., March 2003), low-bit-rate stereo coding is based on the extraction and quantization of a parametric representation of the stereo image. The parameters are then transmitted as side information together with a mono downmix signal encoded by a core coder. At the decoder, the stereo signal can be reconstructed based on the mono downmix signal and the side information, i.e. the stereo parameters containing the spatial (left and right) information of the stereo signal.

For a stereo codec, if the downmix mono signal is classified as transient, there may be pre-echo artefacts in the reconstructed stereo signal. The post-processing may be done to improve the quality of this type of signal whose both channels are transient or only one channel is transient. But for a parametric stereo codec, there are conventionally not enough bits to encode the time envelope of both channels.

In other prior art (WO 02/093560 A1) (Improved Transient Pre-Noise Performance of Low Bit Rate Audio Coders Using Time Scaling Synthesis, AES 117, October 2004), the input mono signal is classified into transient and normal categories in the encoder. Then, at the decoder side, based on the transmitted classification information, a time scaling synthesis algorithm is used to improve the quality. All those kinds of algorithms are applied to the mono downmix signal.

The limitation of the bandwidth available for transmitting signals is not only encountered for the transmission of stereo speech or audio signals but forms a general problem for multi-channel audio signal transmission, the stereo audio coding representing a specific case of multi-channel audio coding.

SUMMARY

A goal to be achieved by the present invention is to provide an improved low-bit-rate parametric multi-channel or parametric stereo audio coding method, which allows to reduce pre-echo artefacts in case of transient audio signals in a bandwidth efficient manner.

According to a first aspect, a device for post-processing at least one of a left and a right channel signals of a stereo signal, the left and the right channel signals being generated from a decoded downmix signal by a low-bit-rate audio coding/decoding system, is suggested, wherein the device has a receiver and a post-processor. The receiver is configured to receive the left channel signal and the right channel signal generated from the decoded downmix signal, a time envelope of the decoded downmix signal, an interchannel time difference between the left channel signal and the right channel signal of the stereo signal and a classification indication indicating a transient type of the downmix signal or of the stereo signal. The post-processor is configured to post-process at least one of the left and right channel signals based on the time envelope of the decoded downmix signal weighted by a respective weighting factor and in dependence on the interchannel time difference and on the classification indication.

The downmix signal, which may be also called mono downmix signal or mono signal in case of stereo audio coding, may optionally be generated from the left and the right channel signals at the encoder side. The generated encoded downmix signal may optionally be transferred together with the side information over an audio channel, or in general, over a transmission link to the device for post-processing. Said device for post-processing may be part of a decoder.

Further, there may optionally be a transient detection model or entity in the encoder for providing an indication to the device for post-processing indicating if the downmix signal is transient or not. In particular, if the downmix signal is classified as transient by the transient detection model, the time envelope of the mono downmix signal may optionally be extracted and transmitted as additional side information to the decoder which may include said device for post-processing.

According to a first implementation form of the first aspect, the device may further have a decider for deciding which one of the left channel signal and the right channel signal of the stereo signal comes firstly, said decider being configured to decide in dependence on the inter channel time difference.

In other words, according to a first implementation form of the first aspect, the device may further have a decider adapted for deciding dependent or based on the interchannel time difference, which one of the left channel signal and the right channel signal of the stereo signal is delayed with regard to the other channel signal of the stereo signal.

According to a second implementation form of the first aspect, the device may further have a decider adapted for deciding based on the interchannel time difference, whether one of the left channel signal and the right channel signal of the stereo signal is delayed with regard to the other channel signal, and, if one of the left channel signal and the right channel signal of the stereo signal is delayed with regard to the other channel signal, to delay the time envelope of the downmix signal to obtain a delayed time envelope for post-processing the delayed channel signal of the stereo signal. The post-processor is adapted to post-process the delayed channel signal by using the delayed time envelope weighted by the respective weighting factor, e.g. by multiplying the delayed channel signal with the delayed time envelope weighted by the respective weighting factor.

According to a third implementation form of the first aspect, the device may further have a decider adapted for deciding based on the interchannel time difference, whether one of the left channel signal and the right channel signal of the stereo signal is delayed with regard to the other channel signal, and, if one of the left channel signal and the right channel signal of the stereo signal is delayed with regard to the other channel signal, to delay the time envelope of the downmix signal to obtain a delayed time envelope for post-processing the delayed channel signal of the stereo signal, wherein the decider is adapted to delay the time envelope of the downmix signal such that a delay or time difference between the delayed channel signal and the time envelope of the downmix signal is reduced.

According to a fourth implementation form of the first aspect, the device may further have a decider adapted for deciding based on the interchannel time difference, whether one of the left channel signal and the right channel signal of the stereo signal is delayed with regard to the other channel signal, and, if one of the left channel signal and the right channel signal of the stereo signal is delayed with regard to the other channel signal, to delay the time envelope of the downmix signal to obtain a delayed time envelope for post-processing the delayed channel signal of the stereo signal, wherein the decider is adapted to delay the time envelope of the downmix signal by the interchannel time difference.

According to a fifth implementation form of the first aspect, the device may further have a decider adapted for deciding based on the interchannel time difference, whether one of the left channel signal and the right channel signal of the stereo signal is delayed with regard to the other channel signal, and, if one of the left channel signal and the right channel signal of the stereo signal is delayed with regard to the other channel signal, to post-process the delayed channel signal of the stereo signal using the delayed time envelope of the decoded downmix signal weighted by the respective weighting factor.

According to a sixth implementation form of the first aspect, the device may further have a decider adapted for deciding based on the interchannel time difference, whether one of the left channel signal and the right channel signal of the stereo signal is delayed with regard to the other channel signal, and, if one of the left channel signal and the right channel signal of the stereo signal is delayed with regard to the other channel signal, to post-process the delayed channel signal of the stereo signal using a delayed time envelope of the decoded downmix signal weighted by the respective weighting factor, and to post-process the other not delayed channel signal using the time envelope of the decoded downmix signal weighted by a respective weighting factor.

According to a seventh implementation form of the first aspect, the classification indication is a classification indication indicating a transient type of the downmix signal.

According to an eighth implementation form of the first aspect, the classification indication is a classification indication indicating a transient type of the stereo signal.

According to a ninth implementation form of the first aspect, the device may further have a decider adapted to decide which one or ones of the left and right channel signals are post-processed, wherein the decider is configured to decide dependent on the classification indication indicating a transient type of the downmix signal or dependent on a classification type indicating a transient type of the stereo signal.

According to a tenth implementation form of the first aspect, the device may further have a decider adapted to decide which one or ones of the left and right channel signals are post-processed, wherein the decider is configured to decide which one or ones of the left and right channel signals are post-processed dependent on the classification indication indicating a transient type of the downmix signal.

According to an eleventh implementation form of the first aspect, the device may further have a decider adapted to decide which one or ones of the left and right channel signals are post-processed, wherein the decider is configured to decide to post-process none of the left and right channel signals in case the classification indication indicates that the downmix signal is not mono transient.

According to a twelfth implementation form of the first aspect, the device may further have a decider adapted to decide which one or ones of the left and right channel signals are post-processed, wherein the decider is configured to decide to post-process at least one of the left and right channel signals in case the classification indication indicates that the downmix signal is mono transient.

According to a thirteenth implementation form of the first aspect, the device may further have a decider adapted to decide which one or ones of the left and right channel signals are post-processed, wherein the decider is configured to decide to post-process at least one of the left and right channel signals in case the classification indication indicates that the downmix signal is mono transient, wherein the decider is further adapted to decide based on the interchannel time difference, whether one of the left channel signal and the right channel signal of the stereo signal is delayed with regard to the other channel signal of the stereo signal, and, if one of the left channel signal and the right channel signal of the stereo signal is delayed with regard to the other channel signal, to post-process the delayed channel signal of the stereo signal using a delayed time envelope of the decoded downmix signal weighted by the respective weighting factor.

According to a fourteenth implementation form of the first aspect, the device may further have a decider adapted to decide which one or ones of the left and right channel signals are post-processed, wherein the decider is configured to decide to post-process at least one of the left and right channel signals in case the classification indication indicates that the downmix signal is mono transient, wherein the decider is further adapted to decide based on the interchannel time difference, whether one of the left channel signal and the right channel signal of the stereo signal is delayed with regard to the other channel signal of the stereo signal, and, if one of the left channel signal and the right channel signal of the stereo signal is delayed with regard to the other channel signal, to post-process the delayed channel signal of the stereo signal using a delayed time envelope of the decoded downmix signal weighted by the respective weighting factor, and to post-process the other not delayed channel signal using the time envelope of the decoded downmix signal weighted by a respective weighting factor.

According to a fifteenth implementation form of the first aspect, the device may further have a decider adapted to decide which one or ones of the left and right channel signals are post-processed, wherein the decider is configured to decide which one or ones of the left and right channel signals are post-processed dependent on the classification indication indicating a transient type of the stereo signal.

According to a sixteenth implementation form of the first aspect, the device may further have a decider adapted to decide which one or ones of the left and right channel signals are post-processed, wherein the decider is configured to decide to post-process only one of the left and right channel signals in case the classification indication indicates that the downmix signal is stereo transient.

According to a seventeenth implementation form of the first aspect, the device may further have a decider adapted to decide which one or ones of the left and right channel signals are post-processed, wherein the decider is configured to decide to post-process only one of the left and right channel signals in case the classification indication indicates that the downmix signal is stereo transient, wherein the decider is further adapted to decide that the one of the left and the right channel signals having the higher signal energy is to be post-processed.

The signal energies of the left and right channel signals can be determined, e.g., by the encoder and transmitted to the device or decoder as side information to the downmix signal.

According to an eighteenth implementation form of the first aspect, the device may further have a decider adapted to decide which one or ones of the left and right channel signals are post-processed, wherein the decider is configured to decide to post-process only one of the left and right channel signals in case the classification indication indicates that the downmix signal is stereo transient, wherein the decider is further adapted to evaluate a channel level difference (CLD) between the left and right channel signal and to decide based on the channel level difference that the one of the left and the right channel signals having the higher signal energy is to be post-processed.

The channel level difference can be determined, e.g., by the encoder and transmitted to the device or decoder as side information to the downmix signal.

According to a nineteenth implementation form of the first aspect, the device may further have a decider adapted to decide which one or ones of the left and right channel signals are post-processed, wherein the decider is configured to decide to post-process only one of the left and right channel signals in case the classification indication indicates that the downmix signal is stereo transient, wherein the decider is further adapted to evaluate a channel level difference (CLD) between the left and right channel signal and to decide that the one of the left and the right channel signals having the higher signal energy is to be post-processed by using the time envelope of the downmix signal weighted by the weighting factor and without delaying the time envelope.

According to a twentieth implementation form of the first aspect, the device may further have a decider adapted to decide which one or ones of the left and right channel signals are post-processed, wherein the decider is configured to decide based on the classification indication indicating a transient type of the downmix signal and on a further classification indication indicating a transient type of the stereo signal.

According to a twenty-first implementation form of the first aspect, the device may further have a decider adapted to decide which one or ones of the left and right channel signals are post-processed, wherein the decider is configured to decide that both channel signals, the left and the right channel signal, are post-processed in case the classification indication indicates that the downmix signal is mono transient and the further classification indication indicates that the stereo signal is not stereo transient.

According to a twenty-second implementation form of the first aspect, the device may further have a decider adapted to decide which one or ones of the left and right channel signals are post-processed, wherein the decider is configured to decide that both channel signals, the left and the right channel signal, are post-processed in case the classification indication indicates that the downmix signal is mono transient and the further classification indication indicates that the stereo signal is not stereo transient, and wherein the decider is further adapted to decide based on the interchannel time difference, whether one of the left channel signal and the right channel signal of the stereo signal is delayed with regard to the other channel signal of the stereo signal, and, if one of the left channel signal and the right channel signal of the stereo signal is delayed with regard to the other channel signal, to post-process the delayed channel signal of the stereo signal using a delayed time envelope of the decoded downmix signal weighted by the respective weighting factor.

According to a twenty-third implementation form of the first aspect, the device may further have a decider adapted to decide which one or ones of the left and right channel signals are post-processed, wherein the decider is configured to decide that both channel signals, the left and the right channel signal, are post-processed in case the classification indication indicates that the downmix signal is mono transient and the further classification indication indicates that the stereo signal is not stereo transient, and wherein the decider is further adapted to decide based on the interchannel time difference, whether one of the left channel signal and the right channel signal of the stereo signal is delayed with regard to the other channel signal of the stereo signal, and, if one of the left channel signal and the right channel signal of the stereo signal is delayed with regard to the other channel signal, to post-process the delayed channel signal of the stereo signal using a delayed time envelope of the decoded downmix signal weighted by the respective weighting factor, and to post-process the other not delayed channel signal using the time envelope of the decoded downmix signal weighted by a respective weighting factor.

According to a twenty-fourth implementation form of the first aspect, the classification indication indicates that the stereo signal is stereo transient in case a change over time of a relation between an energy of the right channel signal and an energy of the left channel signal of the stereo signal exceeds a predetermined threshold.

According to a twenty-fifth implementation form of the first aspect, the classification indication indicates that a stereo signal is stereo transient in case a change over time of a channel level difference (CLD) determined between the right channel signal and the left channel signal of the stereo signal exceeds a predetermined threshold.

According to a twenty-sixth implementation form of the first aspect, the further classification indicates that the downmix signal is downmix transient in case a change over time of an energy of the downmix signal exceeds a predetermined threshold. If the downmix signal is a mono downmix signal, the downmix signal can also be referred to as being mono transient in case a change over time of an energy of the downmix signal exceeds a predetermined threshold.

According to a twenty-seventh implementation form, the post-processor may be adapted to post-process the left channel signal using the, optionally delayed, time envelope of the decoded downmix signal weighted by a first weighting factor, and to post-process the right channel signal using the, optionally delayed, time envelope of the decoded downmix signal weighted by a second weighting factor. The first weighting factor and the second weighting factor being different.

According to a twenty-eighth implementation form, the post-processor comprises a first and a second post-processing entity for post-processing the left and/or right channel signal. The first post-processing entity may be configured to post-process the left channel signal using the, optionally delayed, time envelope of the decoded downmix signal weighted by a first weighting factor. The second post-processing entity may be configured to post-process the right channel signal using the, optionally delayed, time envelope of the decoded downmix signal weighted by a second weighting factor.

According to a twenty-ninth implementation form of the first aspect, the device may further have a decider for deciding which one of the left channel signal and the right channel signal of the stereo signal comes firstly, said decider being configured to decide in dependence on the inter channel time difference, wherein the post-processor has two post-processing entities for post-processing the recovered left and right channel signals, wherein the two post-processing entities are configured to post-process the one of the recovered left and right channel signals which comes firstly using the time envelope of the decoded downmix signal weighted by a first weighting factor and to post-process the other one of the recovered left and right channel signals using the time envelope of the decoded downmix signal weighted by a second weighting factor and delayed by the interchannel time difference.

According to a thirtieth implementation form of the first aspect, the device may further have a decider, a first post-processing entity and a second post-processing entity, said decider being configured to decide which one of the left channel signal and the right channel signal of the stereo signal comes firstly, said decider being configured to decide in dependence on the inter channel time signal, wherein, if the left channel signal comes firstly, the first post-processing entity being configured to post-process the left channel signal using the time envelope of the decoded downmix signal weighted by a first weighting factor, and the second post-processing entity being configured to post-process the right channel signal using the time envelope of the decoded downmix signal weighted by a second weighting factor and delayed by the interchannel time difference.

According to a thirty-first implementation form of the first aspect, the device may further have a decider, a first post-processing entity and a second post-processing entity, said decider being configured to decide which one of the left channel signal and the right channel signal of the stereo signal comes firstly, said decider being configured to decide in dependence on the inter channel time signal, wherein, if the right channel signal comes firstly, the first post-processing entity being configured to post-process the left channel signal using the time envelope of the decoded downmix signal weighted by a first weighting factor and delayed by the inter channel time difference, and the second post-processing entity being configured to post-process the right channel signal using the time envelope of the decoded downmix signal weighted by a second weighting factor.

According to a thirty-second implementation form of the first aspect, the post-processor may be configured to post-process the recovered left and right channel signals based on the time envelope of the decoded downmix signal weighted by a respective weighting factor and in dependence on the inter channel time difference, if the classification indication indicates an non-transient type of the stereo signal.

According to a thirty-third implementation form of the first aspect, the post-processor may be configured to post-process at least one of the left and right channel signals based on the time envelope of the decoded downmix signal weighted by a respective weighting factor and in dependence on the interchannel time difference and on the classification indication indicating a transient type of the stereo signal.

According to a thirty-fifth implementation form of the first aspect, the post-processor may be configured to post-process the recovered left and right channel signals based on the time envelope of the decoded downmix signal weighted by a respective weighting factor and in dependence on the inter channel time difference, if the classification indication indicates a non-transient type, and wherein the post-processor is further configured to post-process at least one of the left and right channel signals based on the time envelope of the decoded downmix signal weighted by a respective weighting factor and in dependence on the classification indication, if the classification indication indicates a transient type of the stereo signal.

According to a thirty-sixth implementation form of the first aspect, the post-processor may be configured to post-process the one of the left and the right channel signals having the higher signal energy, if the classification indication indicates a transient type of the stereo signal.

According to a thirty-seventh implementation form of the first aspect, the device may further have a decider for deciding which one or ones of the left and right channel signals are post-processed, if the classification indication indicates a transient type of the stereo signal, said decider being configured to decide in dependence on the classification indication indicating a transient type of the stereo signal and on a further classification indication indicating a transient type of the decoded downmix signal.

According to a thirty-eight implementation form of the first aspect, the device may further have a decider for deciding which one or ones of the left and right channel signals are post-processed, if the classification indication indicates a transient type of the stereo signal, said decider being configured to decide in dependence on the classification indication indicating a transient type of the stereo signal and on a further classification indication indicating a transient type of the decoded downmix signal, wherein the decider is configured to control the first post-processing entity and the second post-processing entity.

According to a thirty-ninth implementation form of the first aspect, the device may further have a decider for deciding which one or ones of the left and right channel signals are post-processed, if the classification indication indicates a transient type of the stereo signal, wherein the decider is configured to decide that the one of the left and the right channel signals having the higher signal energy is post-processed.

Additionally to the ITD, the decider may optionally receive and use a channel level difference (CLD) and other stereo parameters. The CLD and the other stereo parameters may optionally be provided by the encoder.

According to some implementation forms, the device may optionally have a decider for deciding which one or ones of the left and right channel signals are post-processed, said decider being configured to decide in dependence on the classification indication indicating a transient type of the stereo signal, wherein the decider may optionally be configured to decide that the right and the left channel signals are post-processed, if the classification indication indicates a non-transient type of the stereo signal.

Thus, if the downmix signal is of the transient type and the stereo signal is of the non-transient type, both the right and the left channel signals are optionally post-processed. For post-processing the right and the left channel signals, the time envelope of the decoded downmix signal—also called mono time envelope—may be used differently weighted by different weighting factors.

According to some implementation forms, the device may optionally have a decider, a first post-processing entity and a second post-processing entity. The decider may optionally be configured to decide which one or ones of the left and right channel signals are post-processed, said decider may optionally be configured to decide in dependence on the classification indication. The first processing entity may optionally be configured to post-process the left channel signal using the received time envelope of the decoded downmix signal weighted by a first weighting factor. The second post-processing entity may optionally be configured to post-process the right channel signal using the received time envelope of the decoded downmix signal weighted by a second weighting factor.

The decider may optionally be configured to calculate the first weighting factor and the second weighting factor in dependence on a received channel level difference (CLD) of the left and the right channel of the stereo signal.

According to some implementation forms, the device may optionally have a decider, a first post-processing entity and a second post-processing entity. The decider may optionally be configured to decide which one or ones of the left and right channel signals are post-processed, said decider may be configured to decide in dependence on the classification indication. The first processing entity may optionally be configured to post-process the left channel signal using the received time envelope of the decoded downmix signal weighted by a first weighting factor. The second post-processing entity may optionally be configured to post-process the right channel signal using the received time envelope of the decoded downmix signal weighted by a second weighting factor. The decider may optionally be configured to calculate the first weighting factor aleft by $$a_{left} = \frac{2c}{1+c}$$

and the second weighting factor aright by $$a_{right} = \frac{2}{1+c}, \text{ wherein}$$

$$c = 10^{\frac{cld}{20}},$$

$$cld = \frac{1}{N}\sum_{b=0}^{b=N} CLD[b], \text{ and}$$

-continued $$CLD[b] = 10\log_{10}\frac{\sum_{k=k_b}^{k_{b+1}-1} X_1[k]X_1^*[k]}{\sum_{k=k_b}^{k_{b+1}-1} X_2[k]X_2^*[k]}.$$

In detail, the channel level differences (CLDs) may optionally be extracted from the left and the right channel signal at the encoder side by using the following equation:

$$CLD[b] = 10\log_{10}\frac{\sum_{k=k_b}^{k_{b+1}-1} X_1[k]X_1^*[k]}{\sum_{k=k_b}^{k_{b+1}-1} X_2[k]X_2^*[k]} \quad (1)$$

where k is the index of frequency bin, b is the index of frequency band, kb is the start bin of band b, and X1 and X2 are the spectrums of the left and the right channels, respectively.

Further, the classification indication may optionally be generated based on CLD monitoring. If a fast change of CLD between two consecutive frames is detected, the stereo signal may optionally be classified as stereo transient.

A parameter named CLD_dq can be used to decide the energy relation of two channels. It may optionally be calculated as the average of all higher bands CLD using the above mentioned equation (2). Further, the CLD of the first band of higher band may be used as the CLD_dq.

If CLD_dq is greater than 0, the energy of the left channel is higher than the energy of right channel.

The weighting factor applied to the mono time envelope may optionally be calculated in following way. The first step may optionally be to calculate the average of CLD $$cld = \frac{1}{N}\sum_{b=0}^{b=N} CLD[b] \quad (2)$$

The second step may be to calculate c $$c = 10^{\frac{cld}{20}} \quad (3)$$

The last step may optionally be to calculate the weighting factor a left of the left channel signal and the weighting factor aright of the right channel signal:

$$a_{left} = \frac{2c}{1+c} \quad (4)$$

and $$a_{right} = \frac{2}{1+c} \quad (5)$$

Before applying the time envelope coming from the mono decoding process to the left and right channels, the time envelope is optionally multiplied by the corresponding calculated weighting factors.

According to a further implementation form, the decider is adapted to control the post-processor (or the first and second post-processing entity) to post-process or not post-process the left and right channel signal according to any of the aforementioned implementation forms.

Any implementation form of the first aspect may be combined with any other implementation form of the first aspect to obtain another implementation form of the first aspect.

According to a second aspect, a decoder for decoding a downmix signal processed from a stereo signal by a low-bit-rate audio coding system is suggested, the decoder having a mono decoder for decoding the downmix signal received over an audio channel, and an above described device for post-processing the decoded downmix signal.

According to a first implementation form of the second aspect, the decoder may have an upmixer for generating the left and the right channel signal of the stereo signal in dependence on the downmix signal and an inter channel time difference between the left channel signal and the right channel signal of the stereo signal.

The decoder may optionally be any decoding means. Furthermore, the post-processor may optionally be any post-processing means. Moreover, the upmixer may optionally be any upmixing means.

The respective means, in particular the decoder, the post-processor and the upmixer, may optionally be implemented in hardware or in software. If said means are implemented in hardware, it may optionally be embodied as a device, e.g. as a computer or as a processor or as a part of a system, e.g. a computer system. If said means are implemented in software it may optionally be embodied as a computer program product, as a function, as a routine, as a program code or as an executable object.

Any implementation form of the second aspect may be combined with any other implementation form of the second aspect to obtain another implementation form of the second aspect.

According to a third aspect, a method for post-processing a decoded stereo signal processed from a stereo signal by a low-bit-rate audio coding system is suggested. The method is for post-processing at least one of a left and a right channel signal of the stereo signal, the left and the right channel signals being generated from a decoded downmix signal by a low-bit-rate audio coding/decoding system. The method has a step of receiving the left channel signal and the right channel signal generated from the decoded downmix signal, a time envelope of the decoded downmix signal, an inter channel time difference between the left channel signal and the right channel signal of the stereo signal and a classification indication indicating a transient type of the downmix signal or of the stereo signal, and a step of post-processing at least one of the left and right channel signals based on the time envelope of the decoded downmix signal weighted by a respective weighting factor and in dependence on the inter channel time difference and on the classification indication.

Any implementation form of the third aspect may be implemented according to any implementation form of the first or second aspect to obtain corresponding implementation forms of the third aspect.

According to a fourth aspect, the invention relates to a computer program comprising a program code for executing the method for post-processing a decoded transient downmix signal processed from a stereo signal by a low-bit-rate audio coding system when run on at least one computer.

According to a fifth aspect, the invention relates to a device for post-processing at least one channel signal of a plurality of channel signals of a multi-channel signal, the at least one channel signal being generated from a decoded downmix signal by a low-bit-rate audio coding/decoding system, the device comprising a receiver and a post-processor. The receiver is adapted to receive the at least one channel signal generated from the decoded downmix signal, a time envelope of the decoded downmix signal, an inter-channel time difference between the channel signal and the downmix signal, and a classification indication indicating a transient type of the downmix signal. The post-processor is adapted to post-process the at least one channel signal based on the time envelope of the decoded downmix signal weighted by a respective weighting factor and in dependence on the classification indication and the interchannel time difference.

A multi-channel signal with more than two channel signals can be downmixed such that the multi-channel signal is represented by only one single downmix signal and a corresponding set of spatial audio parameters to be able to reconstruct the more than two channel signals from the single downmix signal. This single downmix signal is also referred to as mono downmix signal. In other words, for a mono downmix a multi-channel signal with, e.g., five channel signals, e.g. a front channel signal, a left channel signal, a right channel signal, a left rear channel signal and right rear channel signal, is downmixed to one single mono downmix signal. The downmix of a stereo signal to one single downmix signal is a specific case of the mono downmix of a multi-channel signal.

However, a multi-channel signal with more than two channel signals, i.e. $M>2$, can be downmixed such that the multi-channel signal is represented by two or more downmix signals (but typically less than M) and corresponding sets of spatial audio parameters to be able to reconstruct the more than two channel signals from the two or more downmix signals. Each downmix signal is derived from at least two of the more than two channel signals of the multi channel signal. In case channel signals from the left side and central signals (e.g. a front channel signal arranged in the center between the left and right side) are used to obtain a first downmix signal and channel signals from the right side and central signals are used to obtain a second downmix signal, both downmix signals are also referred to as stereo downmix signals, i.e. the left and right stereo downmix signal. In other words, for a stereo downmix, a multi-channel signal with, e.g., five channel signals, e.g. a front channel signal, a left channel signal, a right channel signal, a left rear channel signal and right rear channel signal, is downmixed to a left stereo downmix signal and to a right stereo downmix signal. The downmix to more than one downmix signal is not limited to stereo downmix signals and can comprise any number of downmix signals resulting from any combination of multi-channel signals of the multi-channel signal. The corresponding downmix signals may, therefore, also be referred to as first, second, etc. downmix channel signal, which form in their entirety the overall downmix signal.

According to a first implementation form of the fifth aspect, the device is for use in a parametric multi-channel audio decoder.

According to a second implementation form of the fifth aspect, the plurality of multi-channel signals are generated from a decoded and upmixed version of the downmix signal using parametric side-information associated to the downmix signal.

According to a third implementation form of the fifth aspect, the classification indicates that the downmix signal is downmix transient in case a change over time of an energy of the downmix signal exceeds a predetermined threshold. If the downmix signal is a mono downmix signal, the downmix signal can also be referred to as being mono transient in case a change over time of an energy of the downmix signal exceeds a predetermined threshold.

According to a fourth implementation form of the fifth aspect, the device further comprises a decider for deciding, whether the at least one channel signal of the plurality of channel signals is post-processed, wherein the decider is configured to decide dependent on a classification indication indicating the transient type of the downmix signal.

According to a fifth implementation form of the fifth aspect, the device comprises further a decider adapted to decide, whether the at least one channel signal of the plurality of channel signals is post-processed, wherein the decider is configured to not post-process the at least one channel signal in case the classification indication indicates that the downmix signal is not downmix transient.

According to a sixth implementation form of the fifth aspect, the receiver is adapted to receive the plurality of channel signals, and the device comprises further a decider adapted to decide which one or ones of the channel signals of the plurality of channel signals of the multi-channel signal are post-processed, wherein the decider is configured to decide dependent on the downmix signal.

According to a seventh implementation form of the fifth aspect, the receiver is adapted to receive the plurality of channel signals, and the device comprises further a decider adapted to decide which one or ones of the channel signals of the plurality of channel signals of the multi-channel signal are post-processed, wherein the decider is configured to decide to post-process none of the plurality of channel signals in case the classification indication indicates that the downmix signal is not downmix transient.

According to an eighth implementation form of the fifth aspect, the receiver is adapted to receive the plurality of channel signals and a plurality of interchannel time differences, wherein each of the interchannel time differences is associated to a channel signal of the plurality of channel signals, and wherein each of the interchannel time differences at least indicates, whether the respective channel signal is delayed with regard to the downmix signal, and the device further comprises a decider adapted to decide dependent on the classification indication which one or ones of the plurality of channel signals are post-processed, and to decide dependent on the interchannel time difference, whether the respective channel signal is post-processed by a delayed time envelope of the downmix signal weighted by the respective weighting factor.

According to a ninth implementation form of the fifth aspect, the device may further have a decider adapted for deciding based on the interchannel time difference, whether the at least one channel signal of the plurality of channel signals is delayed with regard to the downmix signal.

According to a tenth implementation form of the fifth aspect, the device may further have a decider adapted for deciding based on the interchannel time difference, whether the at least one channel signal is delayed with regard to the downmix signal, and, if the at least one channel signal is delayed with regard to the other channel signal, to delay the time envelope of the downmix signal to obtain a delayed time envelope for post-processing the delayed channel signal.

According to an eleventh implementation form of the fifth aspect, the device may further have a decider adapted for deciding based on the interchannel time difference, whether one of the at least one channel signal is delayed with regard to the downmix signal, and, if the at least one channel signal is delayed with regard to the other channel signal, to delay the time envelope of the downmix signal to obtain a delayed time envelope for post-processing the delayed channel signal, wherein the decider is adapted to delay the time envelope of the downmix signal such that a delay or time difference between the delayed at least one channel signal and the time envelope of the downmix signal is reduced.

According to a twelfth implementation form of the fifth aspect, the device may further have a decider adapted for deciding based on the interchannel time difference, whether the at least one channel signal is delayed with regard to the downmix signal, and, if the at least one channel signal is delayed with regard to the downmix signal, to delay the time envelope of the downmix signal to obtain a delayed time envelope for post-processing the delayed channel signal, wherein the decider is adapted to delay the time envelope of the downmix signal by the interchannel time difference.

According to a thirteenth implementation form of the fifth aspect, the device may further have a decider adapted for deciding based on the interchannel time difference, whether the at least one channel signal is delayed with regard to the downmix signal, and, if the at least one channel signal is not delayed with regard to the downmix signal, to control the post-processor to post-process the at least one channel signal using the time envelope weighted by the weighting factor, in case the downmix signal is downmix transient.

According to a fourteenth implementation form of the fifth aspect, the receiver is adapted to receive the plurality of channel signals, the plurality of interchannel time differences, and a plurality of further classification indications, wherein each of the further classification indications is associated to a channel signal of the plurality of channel signals, and wherein each of the further classification indications indicates a transient type of the channel signal it is associated to. The device further comprises a decider adapted to decide which one or ones of the plurality of channel signals are post-processed, wherein the decider is configured to decide dependent on the classification indication indicating the transient type of the downmix signal and dependent on the further classification indication indicating a transient type of respective channel signal.

According to a fifteenth implementation form of the fifth aspect, the classification indication indicates that a channel is channel transient in case a change over time of a relation of an energy of the channel signal and an energy of a reference signal exceeds a predetermined threshold.

According to a sixteenth implementation form of the fifth aspect, the classification indicates that a channel is channel transient in case a change over time of a channel level difference (CLD) determined for the respective channel signal and a reference signal exceeds a predetermined threshold.

According to a seventeenth implementation form of the fifth aspect, the reference signal used for determining the channel classification indication and/or the CLD is the downmix signal, one of the plurality of channel signals or a signal derived from at least one of the channel signals As the classification indication of the channel signal, the classification indication of the downmix signal and the other coding parameters, e.g. CLD, are determined at the encoder side to define the temporal and spatial characteristics of the multi-channel signal and to reconstruct the individual channel signals of the multi-channel signal at the decoder from the mono downmix signal, the classification indication of the channel signals, the classification indication of the downmix signal, the interchannel time difference a of the channel signals and the other coding parameters do not only specify the characteristics of the original channel signals (prior to encoding) and their relation among each other, but equally the respective characteristics of the reconstructed channel signals (after decoding) and their relation among each other.

According to an eighteenth implementation form of the fifth aspect, the decider is adapted to receive for each of the plurality of channel signals a channel specific channel level difference CLDm associated to the respective channel signal.

According to a nineteenth implementation form of the fifth aspect, the decider is configured to control the post-processor to post-process the at least one channel signal in case the classification indication indicates that the downmix signal is downmix transient and the further channel specific classification indication associated to the at least one multi-channel signal indicates that the at least one channel is not channel transient.

According to a twentieth implementation form of the fifth aspect, the decider is configured to control the post-processor to post-process the at least one channel signal using a delayed time envelope of the downmix signal weighted by a weighting factor in case the classification indication indicates that the downmix signal is downmix transient, the further channel specific classification indication associated to the at least one multi-channel signal indicates that the at least one channel signal is not channel transient, and the channel specific interchannel time difference indicates that the channel signal is delayed with regard to the downmix signal.

According to a twenty-first implementation form of the fifth aspect, the decider is configured to control the post-processor to post-process the at least one channel signal using a time envelope of the downmix signal weighted by a weighting factor (but not delayed) in case the classification indication indicates that the downmix signal is downmix transient, the further channel specific classification indication associated to the at least one multi-channel signal indicates that the at least one channel signal is not channel transient, and the channel specific interchannel time difference indicates that the channel signal is not delayed with regard to the downmix signal.

According to a twenty-second implementation form of the fifth aspect, the decider is configured to determine the channel specific weighting factor, with which the time envelope of the downmix signal is to be weighted with for the post-processing of the at least one channel signal, dependent on a received channel level difference $CLD_m$ between the at least one channel signal m and a reference signal.

According to a twenty-third implementation form of the fifth embodiment, the decider is configured to determine the channel specific weighting factor $a_m$ $$a_m = \frac{2}{1+c},$$

wherein c is determined by $$c = 10^{\frac{acld_m}{20}},$$

wherein $acld_m$ is determined by $$acld_m = \frac{1}{N}\sum_{b=0}^{b=N} CLD_m[b],$$

wherein $CLD_m[b]$ is determined by $$CLD_m[b] = 10\log_{10}\frac{\sum_{k=k_b}^{k_{b+1}-1} X_{ref}[k]X_{ref}^*[k]}{\sum_{k=k_b}^{k_{b+1}-1} X_m[k]X_m^*[k]},$$

and wherein m is the channel index, k is the index of a frequency bin, b is the index of a frequency band, $k_b$ is the start bin of band b, and $X_{ref}$ is the spectrum of the reference signal and $X_m$ is the spectrum of each channel of the multi-channel signal.

According to a twenty-fourth implementation form of the fifth aspect, the multi-channel signal is a stereo signal, wherein the stereo signal comprises a first channel and a second channel.

According to a twenty-sixth implementation form of the fifth embodiment, the multi-channel signal is a stereo signal, wherein the first channel signal is a left channel signal and the second channel signal is a right channel signal of the stereo signal, or vice versa.

According to a twenty-seventh implementation form of the fifth embodiment, the multi-channel signal is a stereo signal, wherein the stereo signal comprises a first channel signal and a second channel signal, and wherein the reference signal is the first or the second channel signal or the downmix signal of the stereo signal.

Any implementation form of the fifth aspect may be combined with any other implementation form of the fourth aspect to obtain another implementation form of the fifth aspect.

According to a sixth aspect, a decoder for parametric multi-channel audio decoding is provided, the decoder comprising a downmix decoder, an upmixer and a device according to any of the implementation forms of the fifth aspect. The downmix decoder is configured to receive an encoded downmix signal representing a multi-channel signal and to decode the encoded downmix signal to generate a decoded downmix signal. The upmixer is configured to receive the decoded downmix signal from the downmix decoder and multi-channel parameters associated to the decoded downmix signal and to generate an upmixed decoded version of the downmix signal, the upmixed decoded version of the downmix signal forming the multi-channel signal.

According to a first implementation form of the sixth aspect, the decoder further comprises a demultiplexer adapted to receive a multiplexed audio signal and to extract from the multiplexed audio signal the encoded downmix signal and the multi-channel parameters, wherein the multi-channel parameters comprise at least a classification indication of the downmix signal, a time envelope of the downmix signal, the interchannel time difference of the at least one channel signal, and optionally at least the classification indication indicating a transient type of the at least one channel signal.

According to a second implementation form of the sixth aspect, the demultiplexer is adapted to extract for each of the channel signals a channel specific classification indication indicating a transient type of the respective channel signal.

According to a third implementation form of the sixth aspect, the multi-channel parameters comprise for each channel signal of the plurality of channel signals, or at least for a channel signal of a subset of the plurality of channel signals, a channel specific channel level difference associated to the respective channel.

Any implementation form of the sixth aspect may be combined with any other implementation form of the sixth aspect to obtain another implementation form of the sixth aspect.

According to a seventh aspect, a method for post-processing at least one channel signal of a plurality of channel signals of a multi-channel signal is provided, the at least one channel signal being generated from a decoded downmix signal by a low-bit-rate audio coding/decoding system. The method comprises the following steps. Receiving the at least one channel signal generated from the decoded downmix signal, a time envelope of the decoded downmix signal, an interchannel time difference between the channel signal and the downmix signal, and a classification indication indicating a transient type of the downmix signal, wherein the interchannel time difference is associated to the at least one channel signal.

Post-processing the at least one channel signal based on the time envelope of the decoded downmix signal weighted by a respective weighting factor and in dependence on the classification indication and the interchannel time difference.

Any implementation form of the seventh aspect may be implemented according to any implementation form of the fifth or sixth aspect to obtain corresponding implementation forms of the seventh aspect.

According to an eighth aspect, the invention relates to a computer program comprising a program code for executing the method for post-processing a decoded multi-channel signal processed by a low-bit-rate audio coding system according to any of the implementation forms of the seventh aspect, when run on at least one computer.

The respective means, in particular the decoder, the receiver, the decider, the post-processor, and the post-processing entities are functional entities and can be implemented in hardware, in software or as combination of both, as is known to a person skilled in the art. If said means are implemented in hardware, it may be embodied as a device, e.g. as a computer or as a processor or as a part of a system, e.g. a computer system. If said means are implemented in software it may be embodied as a computer program product, as a function, as a routine, as a program code or as an executable object.

The stereo implementation forms of the fifth to eight aspect form a specific implementation form of the multi-channel encoding/decoding because the stereo signal comprises only two channel signals (M=2), the left and the right channel signal, whereas the multi-channel signal may comprise two or more channel signals (M>=2).

The stereo implementation forms of the first to fourth aspect again can be regarded as a further development of the stereo/multi-channel stereo implementation forms according to the fifth to eighth aspects using one of the channel signals (i.e. the left or the right channel signal of the stereo signal) as reference signal for determining the channel transient type of the other channel signal (instead of using the downmix signal as reference signal). The stereo implementations of the first to fourth aspect make further use of the fact that because the stereo signal only comprises two channels the "channel transient classification indication" (and also the $CLD_m$) determined for one of the two channels with regard to the other of the two channel signals at the same time comprises transient information (or energy information) of the reference channel signal. Therefore, the stereo transient classification can be regarded as a specific case of the channel transient classification (of the multi-channel aspects) which is not only associated to one channel signal m but to both channel signals (left and right channel signals) of the stereo signal.

Thus implementation forms of the first to fourth aspect allow to even further reduce the required bandwidth for transmitting the stereo information, in particular the transient information and the energy information (e.g. CLD), as only one stereo classification needs to be transmitted, whereas in case the downmix signal is used as reference, implementation forms of the fifth to eight aspect require two individual channel classification indications (for each of the two channels one).

Turning back to the implementation forms of the multi-channel aspects, in case one of the plurality of channel signals is used as reference signal, the channel transient classification indications for only M−1 channel signals (M being the number of the plurality of channel signals forming the multi-channel signal) are required. The transient classification of the reference signal itself is implicitly included in any of the channel transient classifications of the other M−1 channel signals and the post-processing for the reference channel can be decided like in the implementation forms for the stereo coding according to first to fourth aspect. Correspondingly the decision, whether to post-process the reference channel signal can be performed dependent on one of the M−1 channel transient classifications or dependent on the downmix transient classification information of the downmix signal in combination with one of the M−1 channel transient classifications.

In alternative implementation forms, the transient classification for the reference signal can be performed for the reference signal itself like for the downmix signal, i.e. like the downmix transient classification and without evaluating a relation to another signal.

BRIEF DESCRIPTION OF THE DRAWINGS

Further embodiments of the invention will be described with respect to the following figures in which.

DETAILED DESCRIPTION

Figure 1:
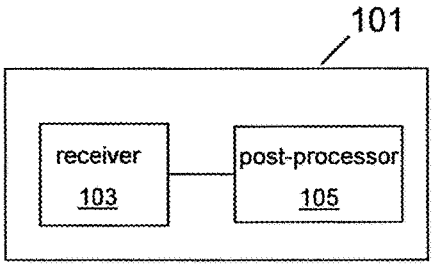
FIG. 1 shows an embodiment of a device for post-processing a decoded stereo signal.

In FIG. 1, an embodiment of a device 101 for post-processing a decoded stereo signal processed by a low-bit-rate audio coding system is illustrated. The device 101 is adapted to post-process at least one of a left or a right channel signal of a stereo signal, the left and right channel signals being generated from a decoded downmix signal by a low-bit-rate audio coding/decoding system. As explained before, the downmix signal associated with the parameters representing the stereo image, in its encoded and decoded version, represents the stereo signal.

The device 101 has a receiver 103 and a post-processor 105.

The receiver 103 is configured to receive a left channel signal and a right channel signal generated from the decoded downmix signal, a time envelope of the decoded downmix signal, an inter channel time difference between the left channel signal and the right channel signal of the stereo signal and a classification indication indicating a transient type of the downmix signal.

Further, the post-processor 105 is adapted to post-process at least one of the left and right channel signals based on the time envelope of the decoded downmix signal weighted by a respective weighting factor and in dependence on the inter channel time difference and on the classification indication. One specific embodiment of a corresponding method executed, e.g., by the device, will be described in more detail based on FIG. 5.

In detail, the inter channel time difference may control whether a or which channel signal is post-processed using a delayed time envelope of the downmix signal. Further, the weighted time envelope of the decoded downmix signal may be a tool for post-processing the selected channel signal or signals.

In a further embodiment of the device, the receiver 103 is configured to receive a left channel signal and a right channel signal generated from the decoded downmix signal, a time envelope of the decoded downmix signal, an inter channel time difference between the left channel signal and the right channel signal of the stereo signal and a classification indication indicating a transient type of the stereo signal. In this further embodiment, the post-processor is adapted to post-process at least one of the left and right channel signals based on the time envelope of the decoded downmix signal weighted by a respective weighting factor and in dependence on the interchannel time difference and on the classification indication indicating a transient type of the stereo signal. One specific embodiment of a corresponding method executed.

In an even further embodiment of the device, the receiver 103 is configured to receive a left channel signal and a right channel signal generated from the decoded downmix signal, a time envelope of the decoded downmix signal, an inter-channel time difference between the left channel signal and the right channel signal of the stereo signal and a classification indication indicating a transient type of the downmix signal and a further classification indication indicating a transient type of the stereo signal. In this further embodiment, the post-processor is adapted to post-process at least one of the left and right channel signals based on the time envelope of the decoded downmix signal weighted by a respective weighting factor and in dependence on the inter-channel time difference, on the classification indication indicating a transient type of the downmix signal and on the further classification indication indicating a transient type of the stereo signal. One specific embodiment of a corresponding method executed, e.g., by the device, will be described in more detail based on FIG. 8.

Figure 2:
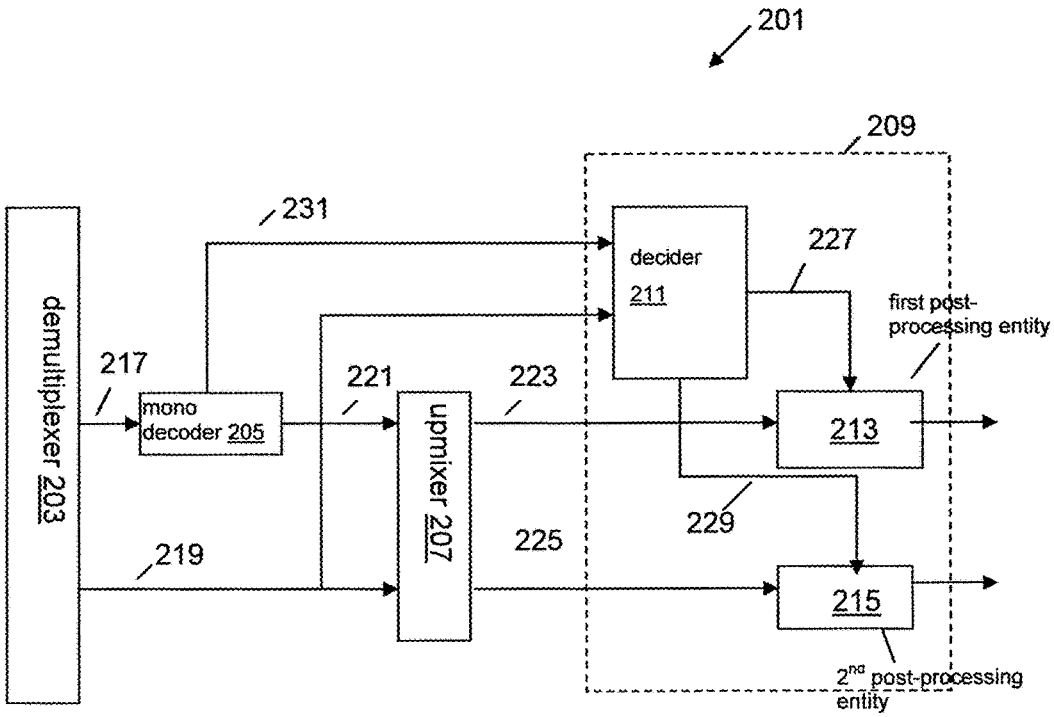
FIG. 2 shows a first embodiment of a decoder including a device for post-processing a decoded stereo signal.

FIG. 2 shows a first embodiment of a decoder 201. The decoder 201 has a demultiplexer 203, a mono decoder 205, an upmixer 207 and a device 209 for post-processing. The device 209 for post-processing has a decider 211, a first post-processing entity 213 and a second post-processing entity 215.

The demultiplexer 203 provides a received downmix signal 217, e.g. a downmix bitstream 217, and further a signal 219, e.g. a set of parameters 219, including the interchannel time difference (ITD) between a left channel signal and a right channel signal of the stereo signal, a channel level difference (CLD) and potentially further stereo parameters.

The mono decoder 205 is configured to receive the downmix signal 217 and to provide a decoded downmix signal 221 to the upmixer 207 and to the device 209.

The upmixer 207 receives the decoded downmix signal 221 and the signal 219 for outputting a left channel signal 223 and a right channel signal 225 of the stereo signal.

The decider 211 of the device 209 is configured to receive a signal 231, e.g. a set of parameters 231, including the time envelope of the decoded downmix signal and a classification indication indicating the type of the decoded downmix signal. The classification indication indicates if the decoded downmix signal is transient or normal. The decider 211 of the device 209 further receives the signal 219 comprising a classification indication indicating a transient type of the stereo signal.

The decider 211 is configured to decide which one or ones of the left and right channel signals 223, 225 are post-processed, and how they are post-processed (in case they are post-processed). In particular, said decider 211 is configured to decide in dependence on the ITD and particularly on the classification indication indicating the transient type of the downmix signal and the classification indication indicating the transient type of the stereo signal. This classification indication may be included in the signal 219. Further, said decider 211 may be configured to control the first processing entity 213 by means of a first control signal 227 and the second post-processing entity 215 by means of a second control signal 229.

The first post-processing entity 213 is configured to post-process the left channel signal 223 using the received time envelope 231 of the decoded downmix signal, wherein said time envelope is weighted by a first weighting factor.

In an analogous way, said second post-processing entity 215 is configured to post-process the right channel signal 225 using the received time envelope 231 of the decoded downmix signal, said time envelope then being weighted by a second weighting factor. Further, the weighted time envelope for the channel signal, which comes not firstly, or in other words, which is delayed with regard to the other channel signal of the stereo signal, is delayed before post-processing.

In this regard, the decider 211 may be configured to calculate the first weighting factor and the second weighting factor in dependence on the received channel level difference of the signal 219 of the left and the right channels of the stereo signal.

Figure 3:
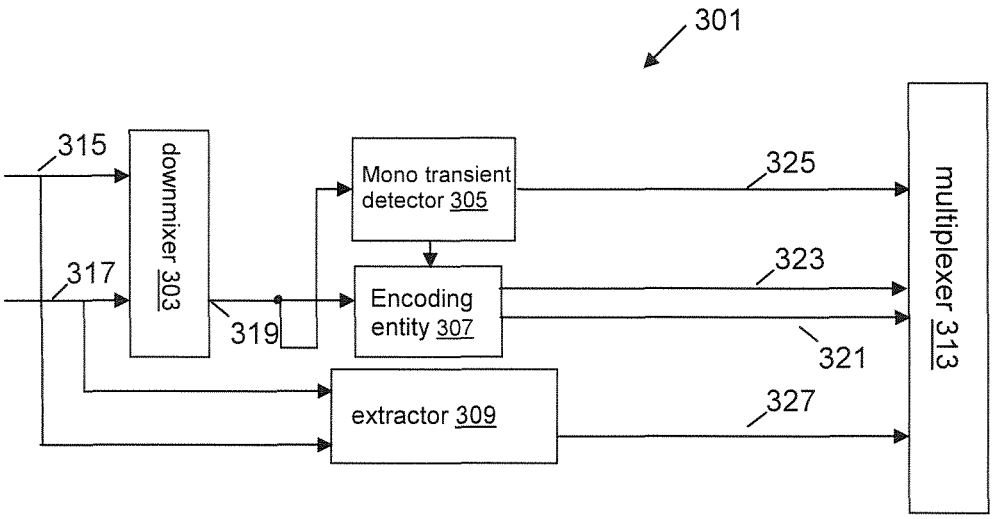
FIG. 3 shows a first embodiment of an encoder coupleable with the decoder of FIG. 2.

With regard to FIG. 2, FIG. 3 shows a first embodiment of an encoder 301 being coupleable with the decoder 201 of FIG. 2. The encoder 301 of FIG. 3 and the decoder 201 of FIG. 2 may be coupled by a transmission channel or any other communication link, e.g. a wired or wireless communication link.

The encoder 301 has a downmixer 303, a downmix transient detector 305, an encoding entity 307, an extractor 309 and a multiplexer 313.

Said downmixer 303 receives a left channel 315 and a right channel 317 of the stereo signal. The downmixer 303 outputs a downmix signal 319, said downmix signal 319 being provided to the downmix transient detector 305 and to the encoding entity 307.

As the downmixer 303 is adapted to downmix the left and right channel to only one single mono downmix signal, the downmixer 303 can also be referred to as mono downmixer 303 and the downmix transient detector 305 as mono transient detector 305 or mono downmix transient detector.

The mono transient detector 305 is adapted to detect whether the mono downmix signal is transient or not, and to output a classification indication 325 indicating whether the mono downmix signal 319 is transient or not. The mono transient detector can be adapted to evaluate the energy of consecutive frames of the mono downmix signal and to detect that the mono downmix signal is transient when a change of the energy of the mono downmix signal from one frame to a consecutive frame exceeds a predetermined threshold.

As for this detection the dynamics or change over time of the mono downmix signal itself (or in general: of the downmix signal itself) is evaluated (in contrast to the stereo transient classification and the channel transient classification explained later, where the dynamics of the energy of two signals are evaluated) this transient classification is also referred to as mono transient classification (or in general: downmix transient classification) and the mono downmix signal is also referred to as being mono transient (or in general: downmix transient) in case the above condition is fulfilled, e.g. the change of the energy of the mono downmix signal (or in general: of the downmix signal) from one frame to a consecutive frame exceeds the predetermined threshold.

Therefore the classification indication 325 indicating a transient type of the (mono) downmix signal, which is the output of the mono transient detector 305, can also be referred to as mono transient classification indication or as transient classification indicating a mono transient type of the mono downmix signal, i.e. indicating whether the mono downmix signal is mono transient or not.

The encoding entity 307 outputs an encoded downmix signal 321, e.g., an encoded downmix bitstream 321, and a time envelope 323 of the downmix signal. The encoding entity can be adapted to extract the time envelope of the mono downmix signal only in case the mono transient detector detects that the mono downmix signal is mono transient. The encoding entity can be adapted, e.g. to divide the whole frame into four sub-frames, to calculate the energy of each sub-frame and to encode the square roots of energy of those four sub-frames to represent the time envelope of the downmix signal.

The extractor 309 is configured to extract the ITD, the CLD and other stereo parameters from the stereo signal. The extracted ITD, CLD and the other stereo parameters from the stereo signal may be transferred by a signal 327, e.g., a bitstream 327.

Moreover, the detector 311 is configured to provide a stereo transient detection and to output a classification indication 329 indicating a transient type of the stereo signal. The detector can be implemented to calculate the channel level difference CLD between the left and the right channel signal for consecutive frames of the stereo signal, and to detect that the stereo signal is transient, in case a change of the CLD of the stereo signal, i.e. between the left and the right channel signal of the stereo signal, from one frame to a consecutive frame exceeds a predetermined threshold.

As for this detection the dynamics or change over time of the relation of the energies of the left and right channel signal, i.e. of two signals, is evaluated (in contrast to the mono transient classification explained above or the general downmix transient classification described later, where the dynamics of the energy of only one signal is evaluated) this transient classification is also referred to as stereo transient classification and the stereo signal is also referred to as being stereo transient in case the above condition is fulfilled, e.g. the magnitude of a change of the CLD of the stereo signal from one frame to a consecutive frame exceeds a predetermined threshold.

Therefore, the extractor 309 may also be referred to as stereo transient detector and the classification indication (included in signal 327) indicating a transient type of the stereo signal can also be referred to as stereo transient classification indication or classification indication indicating a stereo transient type of the stereo signal, i.e. indicating whether the stereo signal is stereo transient or not.

Alternative embodiments of the encoder of FIG. 3 may be adapted to determine only the classification indication indicating a transient type of the downmix signal (and not the classification indication indicating a transient type of the stereo signal) or only the classification indication indicating a transient type of the stereo signal (and not the classification indication indicating a transient type of the downmix signal).

Correspondingly, alternative embodiments of the decoder of FIG. 2 may be adapted to evaluate only the classification indication indicating a transient type of the downmix signal (and not the classification indication indicating a transient type of the stereo signal) or only the classification indication indicating a transient type of the stereo signal (and not the classification indication indicating a transient type of the downmix signal).

Figure 4:
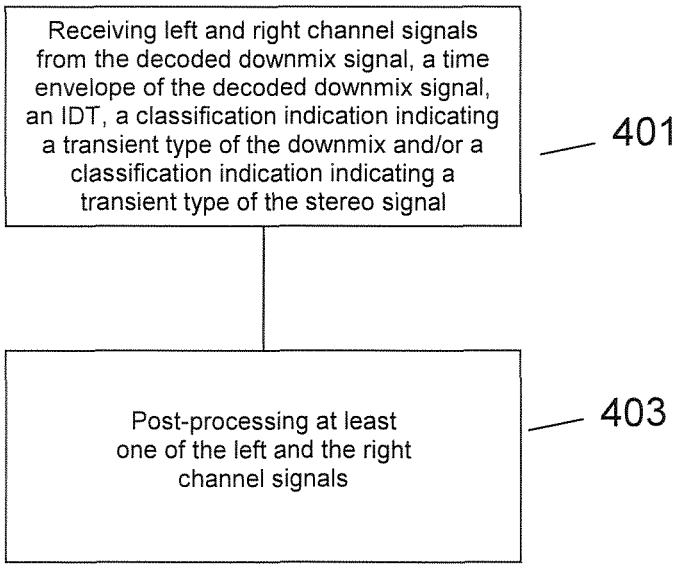
FIG. 4 shows a first embodiment of a method for post-processing a decoded stereo signal.

In FIG. 4, a first embodiment of a method for post-processing a decoded stereo signal is depicted. The method for post-processing is adapted to post-process at least one of the left and right channel signals of the stereo signal, the left and right channel signals being generated from a decoded downmix signal by a low-bit-rate audio coding/decoding system.

In a step 401, the left channel signal and the right channel signal generated from the decoded downmix signal, a time envelope of the decoded downmix signal, an interchannel time difference (ITD) between the left channel signal and the right channel signal of the stereo signal and a classification indication indicating a transient type of the downmix and/or a classification indication indicating a transient type of the stereo signal are received.

In a step 403, at least one of the left and the right channel signals is post-processed based on the time envelope of the decoded downmix signal weighted by a respective weighting factor and in dependence on the ITD and on the classification indication.

The explanations with regard to FIG. 1, in particular with regard to the embodiments of using only the classification indicator indicating a transient type of the downmix signal, only the classification indicator indicating a transient type of the stereo signal, or both, equally apply to the different embodiments.

Figure 5:
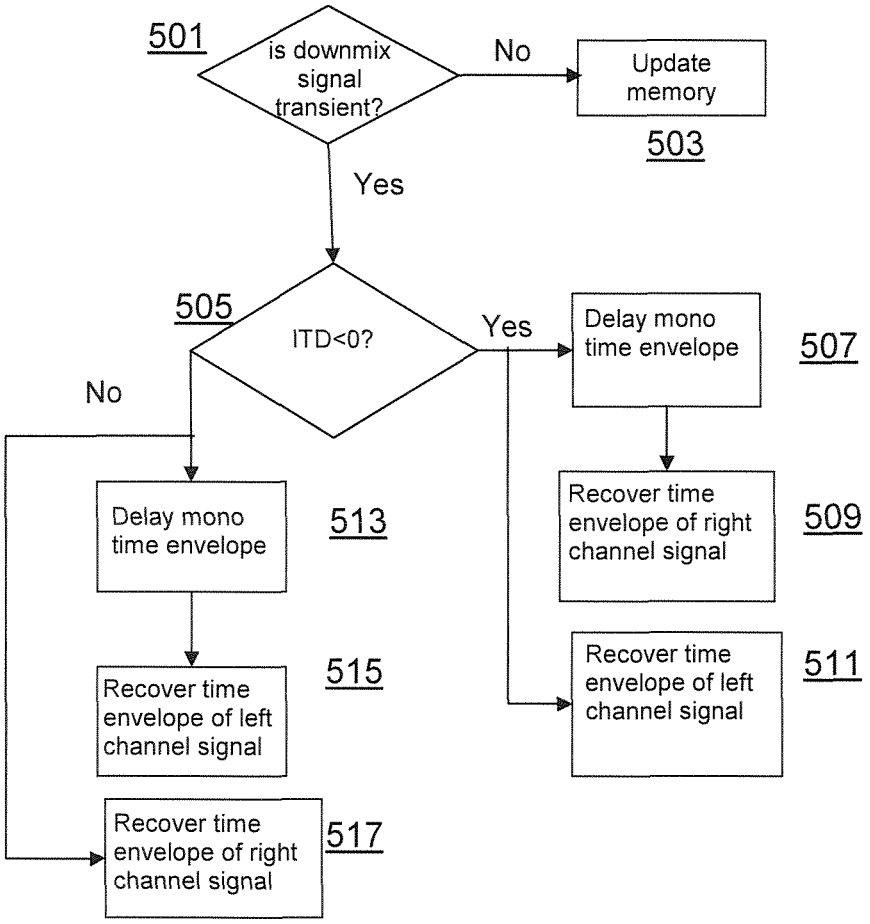
FIG. 5 shows a second embodiment of a method for post-processing a decoded stereo signal.

Further, FIG. 5 shows a second embodiment of a method for post-processing a decoded stereo signal, wherein only the classification indication indicating a transient type of the downmix signal is evaluated (but not the classification indication indicating a transient type of the stereo signal). The method for post-processing is adapted to post-process at least one of the left and right channel signals of the stereo signal, the left and right channel signals being generated from a decoded downmix signal by a low-bit-rate audio coding/decoding system.

In a step 501, it is checked if the decoded downmix signal is transient or not.

If the decoded downmix signal is non-transient, i.e. not transient, e.g. only the memory is updated in a step 503, and none of the left and right channel signals is post-processed by using the weighted time envelope. As the mono downmix signal is typically transient if one or both of the left and right channel signals is transient, it can be assumed that in case the classification indicator indicating the transient type of the downmix signal indicates that the downmix signal is not transient, i.e. the mono downmix signal is not mono transient, none of both of the left and right channel signals is transient, and, therefore no post-processing is required.

If the decoded downmix signal is transient, the method proceeds with step 505.

In step 505, it is checked which one of the left and right channel signals comes firstly. Or, in other words, in step 505, it is checked based on the interchannel time difference (ITD), whether one of the left and right channel signals is delayed with regard to the other channel signal of the stereo signal.

The ITD or Interchannel Time Difference represents the delay between two channels and can be extracted from the stereo signal (but also from a multichannel signal, e.g. the ITD of one channel of the multi-channel signal with regard to a reference channel signal of the multi-channel signal). The ITD expresses the delay typically as number of samples and can be, for example, calculated based on the following equation:

$$ITD = \arg\max_{d} \{IC(d)\},$$

with IC(d) being the normalized cross-correlation defined as $$IC[d] = \frac{\sum_{n=0}^{N-1} x_1[n]x_2[n-d]}{\sqrt{\sum_{n=0}^{N-1} x_1^2[n] \sum_{n=0}^{N-1} x_2^2[n]}},$$

wherein $x_1$ and $x_2$ represent the first signal and second signal to be correlated, d represents the delay or time difference n represents the time index and N represents the maximum time index.

It should be noted that this cross-correlation can be computed on a band per band basis. In that case, each $x_1$ and $x_2$ represents band limited time domain signals. In order to avoid a false detection of ITD, the maximum correlation may be compared with a threshold. If the maximum correlation is higher than the threshold, the detected delay corresponds to the ITD. Otherwise, the detected delay may not represent an ITD, and to avoid introducing a wrong ITD, its value is changed to 0. Thus, ITD=0 may signify that two, e.g. transient signals, arrive at the same point of time (i.e. have no delay with regard to each other), or that the similarity (i.e. correlation) of the two signals was not sufficiently significant.

Alternatively, the ITD may be calculated on other cross-correlations, e.g. non-normalized cross correlations. In addition, e.g., phase difference computations can also be used to estimate the interchannel time difference as presented in "Estimation of Interchannel Time Difference in Frequency Subbands Based on Nonuniform Discrete Fourier Transform", Bo Qiu, Yong Xu, Yadong Lu, and Jun Yang, EURASIP Journal on Audio, Speech, and Music Processing, Volume 2008 (2008).

For the stereo signal, if $x_1$ and $x_2$ correspond to the left and right channel signal respectively, ITD<0 means that the left channel signal comes first (i.e. the right channel signal is delayed with regard to the left channel signal) and ITD>0 means that the right channel signal comes first (i.e. the left channel signal is delayed compared to the right channel signal. Of course a different convention can be adopted for the ITD computation. In that case, the comparison with the threshold 0 is inverted. That is, if $x_1$ and $x_2$ correspond to the right and left channel signal respectively, ITD<0 means that the right channel signal comes first (i.e. the left channel signal is delayed with regard to the right channel signal) and ITD>0 means that the left channel signal comes first (i.e. the right channel signal is delayed compared to the left channel signal). ITD=0 means, for both of the above calculations of the cross correlation, that both signals, the left and the right channel signal are not delayed with regard to each other or are not sufficiently similar.

Using the above equations for calculating the ITD, in case $x_1$ corresponds to the left channel signal and $x_2$ corresponds to the right channel signal, it is defined, that if ITD<0, the left channel signal comes firstly, and if ITD>0, the right channel signal comes firstly. An example for calculating the ITD is described in more detail in reference [4].

Based on the aforementioned calculation of the ITD ($x_1$ corresponds to the left channel signal and $x_2$ corresponds to the right channel signal), it is evaluated in step 505, whether the ITD is smaller than 0, i.e. ITD<0. If the ITD<0 (i.e. the right channel is delayed with regard to the left channel signal), the method proceeds with step 507.

In step 507, the mono time envelope is delayed by ITD samples for post-processing the right channel signal.

Then, in step 509, the time envelope of the right channel signal is recovered using the delayed and weighted mono time envelope.

Further, in step 511, the time envelope of the left channel signal is recovered using the weighted mono time envelope. In detail, in the step 511, there is no time shift.

If in step 505 the result is that the ITD is not smaller than 0, i.e. ITD≥0 (this includes the case ITD>0, i.e. left channel signal is delayed with regard to the right channel signal, and the case ITD=0, i.e. no delay between the two channel signals), then the method proceeds with step 513.

In step 513, the mono time envelope is delayed by ITD samples for post-processing the left channel signal. This includes delaying the time envelope by zero samples, i.e. in fact not delaying the time envelope, in case the ITD is 0.

Then, in step 515, the time envelope of the left channel signal is recovered using the delayed and weighted mono time envelope.

Further, in step 517, the time envelope of the right channel signal is recovered using the weighted mono time envelope. In detail, in step 517, there is no time shift of the weighted mono time envelope.

Alternative embodiments may comprise evaluating at step 505, whether (1) the ITD>0, (2) ITD<0, and (3) ITD=0, and may include a third branch (instead of only two branches (yes and no) of FIG. 5 at step 505) for ITD=0, wherein this branch includes recovering the time envelope of the left channel signal using the weighted mono time envelope, weighted by a first channel specific weighting factor, but without delaying the mono time envelope, and, recovering the time envelope of the right channel signal using the weighted mono time envelope, weighted by a second channel specific weighting factor, but without delaying the mono time envelope.

Examples for calculating the respective weighting factor for weighting the time envelope of the decoded downmix signal are shown above.

Figure 6:
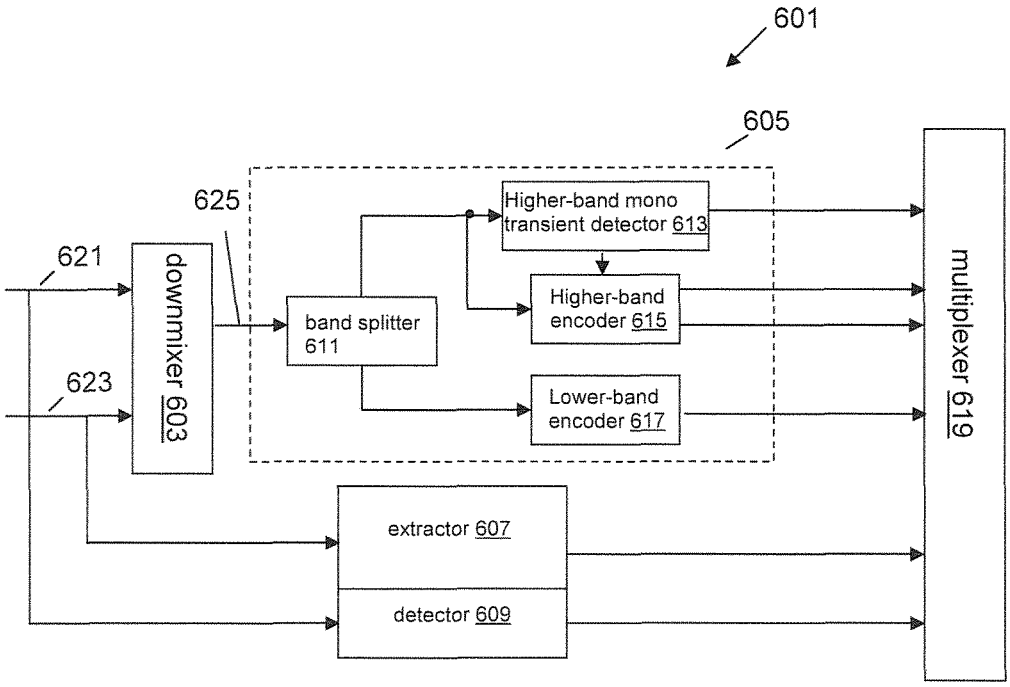
FIG. 6 shows a second embodiment of an encoder coupleable with the decoder of FIG. 7.

In FIG. 6, a second embodiment of an encoder 601 is shown. Said encoder 601 may be coupled with the decoder 701 of FIG. 7. The encoder 601 may be based on G.722/G.711.1 SWB mono.

The encoder 601 of FIG. 6 has a downmixer 603, a mono encoder 605, an extractor 607 and a detector 609. The extractor 607 is configured to extract CLD and other stereo parameters. The detector 609 is configured to provide a stereo transient detection.

The mono encoder 605 has a band splitter 611, a higher-band mono transient detector 613, a higher-band encoder 615 and a lower-band encoder 617.

Further, the encoder 601 has a multiplexer 619.

The downmixer 603 receives a left channel signal 621 and a right channel signal 623 of the stereo signal to be encoded. A downmix signal 625 is generated from the left and the right channel signals 621 and 623 by said downmixer 603. The downmix signal 625 is input to the mono encoder 605.

The input downmix signal 625 is divided into the lower-band and the higher-band parts by the band splitter 611 being exemplarily embodied as QMF band-splitting filter. These are used as inputs to the lower-band encoder 617 and the higher-band encoder 615, respectively.

The higher-band mono transient detector 613 provides a transient detection (i.e. a mono transient classification) based on the energy of the higher-band signal in the time domain. The time envelope of the higher-band signal is extracted and transmitted to the decoder (see FIG. 7) together with the classification information.

For example, the whole frame may be divided into four sub-frames, and the energy of each sub-frame may be calculated. The square roots of energy of those four sub-frames may be encoded to represent the time envelope of the downmix signal.

CLDs are extracted from the left and the right channel signals by using the above-mentioned equations.

Further, a stereo transient may be detected by the stereo transient detector 609. This kind of detection may also be based on CLD monitoring. If a fast change or attack of CLD between two consecutive frames is detected, e.g. the change exceeds a predetermined threshold, the stereo signal may be classified as stereo transient. For example, the detection may be done in the following way. In a first step, the CLD sum is calculated of all the frequency bands in the log domain. In a second step, the average of the CLD sums of previous N frames is calculated. In a third step, the difference between the CLD sum of the current frame and the CLD sum mean of the previous N frames is calculated. In a fourth step, the difference is compared to a threshold to decide if it is a transient stereo signal or not. The threshold may be based on experiments.

As mentioned above, FIG. 7 shows a second embodiment of a decoder 701 being coupleable with the decoder 601 of FIG. 6.

The decoder 701 has a demultiplexer 703, a SWB mono decoder 705, a WB mono decoder 707, a first upmixer 709, a second upmixer 711 and a device for post-processing 713.

The device 713 for post-processing has a decider 715, a first post-processing entity 717 and a second post-processing entity 719.

Further, the decoder 701 has a first quadrature mirror filter (QMF) 721 outputting the decoded and post-processed left channel signal.

Further, the decoder 701 has a second quadrature mirror filter (QMF) 723 for outputting the decoded and post-processed right channel signal.

Thus, the lower-band stereo and the higher-band stereo signals may be reconstructed separately as shown by the outputs of the upmixers 709 and 711, and may be used as input signals of the QMF filter 721 and 723 to generate the output stereo signal. In particular, the stereo post-process algorithm may be only applied to the higher-band decoder.

Alternative embodiments of the encoder of FIG. 6 may be adapted to determine only the classification indication indicating a transient type of the downmix signal (and not the classification indication indicating a transient type of the stereo signal) or only the classification indication indicating a transient type of the stereo signal (and not the classification indication indicating a transient type of the downmix signal).

Figure 7:
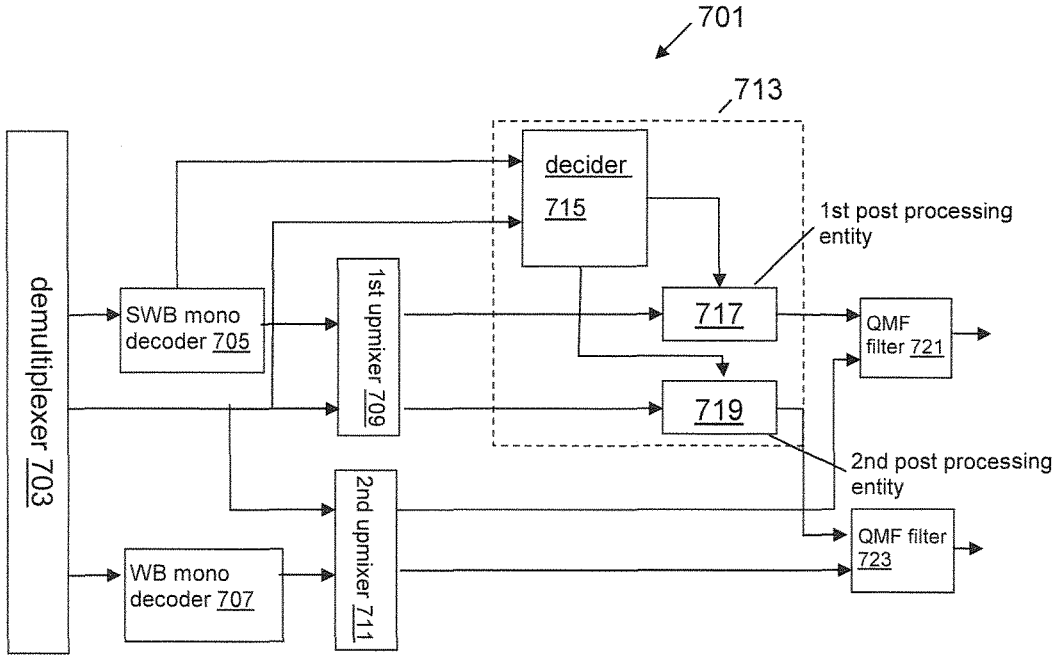
FIG. 7 shows a second embodiment of a decoder including a device for post-processing a decoded stereo signal.

Correspondingly, alternative embodiments of the decoder of FIG. 7 may be adapted to evaluate only the classification indication indicating a transient type of the downmix signal (and not the classification indication indicating a transient type of the stereo signal) or only the classification indication indicating a transient type of the stereo signal (and not the classification indication indicating a transient type of the downmix signal).

Figure 8:
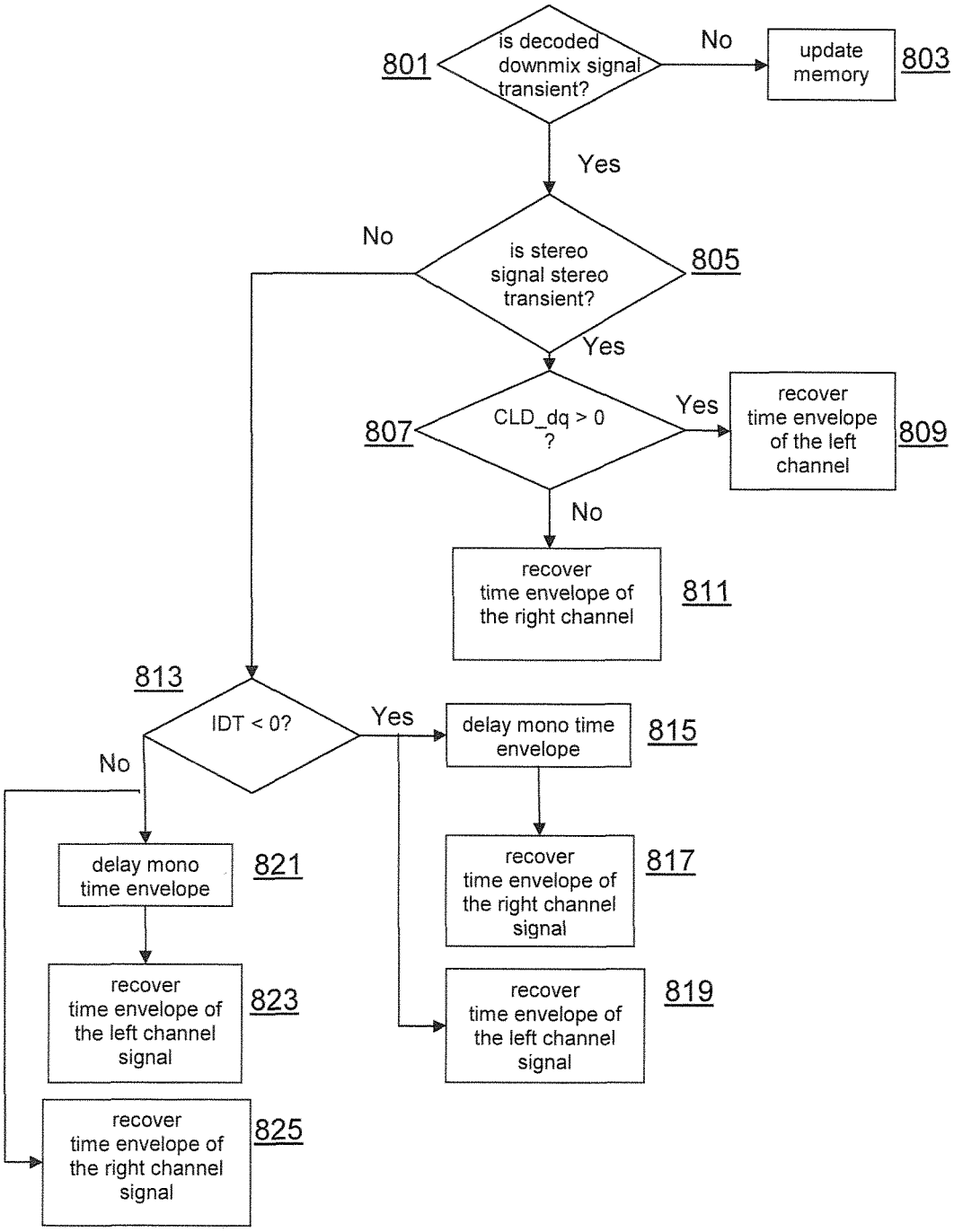
FIG. 8 shows a third embodiment of a method for post-processing a decoded stereo signal.

FIG. 8 shows a third embodiment of a method for post-processing a decoded stereo signal, wherein the classification indication indicating a transient type of the downmix signal and the classification indication indicating a transient type of the stereo signal are evaluated. The method for post-processing is adapted to post-process at least one of the left and right channel signals of the stereo signal, the left and right channel signals being generated from a decoded downmix signal by a low-bit-rate audio coding/decoding system. The explanations provided with regard to FIG. 5 apply correspondingly.

In step 801, it is checked if the decoded downmix signal is transient or not. If the decoded downmix signal is non-transient, only an update of the memory is performed as shown in step 803 and none of the two channel signals, neither the left nor the right channel signal, is post-processed using the weighted time envelope. If the decoded downmix signal is transient, i.e. mono transient, the method proceeds with step 805.

In step 805 it is checked, whether the stereo signal is stereo transient.

The stereo transient classification indication can be regarded as an indicator, whether both channel signals, the left and right channel signal, have a different dynamic, i.e. have a different course over time. As the relation of the course of the left and right channel signals is evaluated, e.g. based on the CLD, the signal will, typically, be classified as stereo transient in case only one of both signals is transient or both are transient but not in the same or similar way, e.g. the energy of the left and right channel signal changes over time in different directions (increase or decrease) or by a different amount. The degree of the difference necessary for a stereo signal to be classified as stereo transient depends on the metric used, e.g. energy, and the predetermined threshold. In view of the aforementioned, in case the downmix signal is mono transient (see step 801) and the stereo signal is not stereo transient, it is assumed that both channel signals, the left and the right channel signal, are transient in a similar manner. Therefore, both channel signals are post-processed using the respective weighted time envelopes to improve the quality of both signals.

In case the downmix signal is mono transient (see step 801) and the stereo signal is stereo transient, it is assumed that only one channel signal, the left or the right channel signal, is transient. Therefore, only one channel signal needs to be post-processed using the respective weighted time envelope to improve the quality of the channel signal. Step 807 is used to determine, which of the both channel signals is the transient one to be post-processed. Furthermore, as only one channel signal is transient, the time envelope of the downmix signal generated from both signals is very similar to a corresponding time envelope of the one transient channel signal as it would have been directly generated from the original transient channel signal. Therefore, it can be assumed that there is no relevant delay between the downmix signal and the transient channel signal. Or in other words, there is no significant delay between the time envelope of the downmix signal and a corresponding time envelope of the transient channel signal (in case it would have been directly derived from the original transient channel signal) is to be reconstructed from the time envelope of the downmix signal. Therefore, no delaying of the time envelope of the downmix signal is required for the post-processing.

Thus, if the step 805 is answered yes (only one of the two channel signals is transient and to be post-processed), the method proceeds with step 807.

If the step 805 is answered no (both channel signals are transient and to be post-processed), the method proceeds with step 813. In this case it is only to be determined, whether one of the signals is delayed with regard to the other channel signal, and correspondingly also with regard to the downmix signal (see step 813, evaluation of the ITD).

In step 807, it is checked if CLD_dq is greater than zero. If CLD_dq is greater than zero, the method proceeds with step 809. If not, the method proceeds with step 811.

In step 809, the time envelope of the left channel is recovered using the weighted time envelope of the decoded downmix signal and the left channel signal is post-processed using the weighted time envelope. Examples for calculating the weighting factor for weighting the time envelope of the decoded downmix signal are shown above.

In step 811, the time envelope of the right channel is recovered using the weighted time envelope of the decoded downmix signal and the right channel signal is post-processed using the weighted time envelope.

Referring to steps 807 to 811, as the left channel signal is the reference signal for the CLD calculation, i.e. is the channel signal in the numerator position of equation (1) defining the CLD, the decoded CLD is greater than zero if the energy of the left channel signal is larger than the energy of the right channel signal. As transient signals typically have higher energies than non-transient signals, the CLD can be used as indicator to decide, which of the both is the transient channel signal. Accordingly, in case the decoded CLD is greater than zero the left channel signal is assumed to be the transient channel signal and post-processed (step 809) using the respective weighted time envelope. In case the decoded CLD is smaller than zero the right channel signal is assumed to be the transient channel signal and post-processed (811) using the respective weighted time envelope.

In further embodiments, the right channel may be used as reference signal and other metrics may be used to determine, which of the two signals is the transient one.

In step 813, it is checked which one of the left and right channel signals comes firstly. It may be defined, as explained above, that if ITD<0, the left channel signal comes firstly. If ITD>0, the right channel signal comes firstly.

If the ITD<0, (i.e. the right channel is delayed with regard to the left channel signal) the method proceeds with step 815. In the step 815, the mono time envelope is delayed by ITD samples for post-processing the right channel signal.

Then, in step 817, the time envelope of the right channel signal is recovered using the delayed and weighted mono time envelope.

Further, in step 819, the time envelope of the left channel signal is recovered using the weighted mono time envelope. In detail, in the step 819, there is no time shift.

If in step 813 the result is the ITD≥0 (this includes the case ITD>0, i.e. left channel signal is delayed with regard to the right channel signal, and the case ITD=0, i.e. no delay between the two channel signals), then the method proceeds with step 821.

In the step 821, the mono time envelope is delayed by ITD samples for post-processing the left channel signal. This includes delaying the time envelope by zero samples, i.e. in fact not delaying the time envelope, in case the ITD is 0.

Alternative embodiments (as explained with regard to FIG. 5) may comprise evaluating at step 813, whether (1) ITD>0, (2) ITD<0, and (3) ITD=0, and may include a third branch (instead of only two branches (yes and no) of FIG. 8 at step 813) for ITD=0, wherein this branch includes recovering the time envelope of the left channel signal using the weighted mono time envelope, weighted by a first channel specific weighting factor, but without delaying the mono time envelope, and, recovering the time envelope of the right channel signal using the weighted mono time envelope, weighted by a second channel specific weighting factor, but without delaying the mono time envelope.

According to FIG. 8 (only two branches yes and no), then, in step 823, the time envelope of the left channel signal is recovered using the delayed and weighted mono time envelope.

Further, in step 825, the time envelope of the right channel signal is recovered using the weighted mono time envelope. In detail, in step 825, there is not time shift of the weighted mono time envelope.

Moreover, if the stereo signal of a current frame is classified as stereo transient, or if the downmix signal of the previous frame was transient and the stereo signal classified as stereo transient at the previous frame, a further decision based on CLD_dq may be needed (see discussion of step 807). Otherwise, such a further decision may be based on the ITD (see discussion of step 813).

CLD_dq may be calculated as the average of all higher bands CLD using the above mentioned equation (2). Further, the CLD of the first band of higher band may be used as CLD_dq.

If only one channel is transient, the energy of that channel is higher than the energy of the other channel. Therefore, in combination with the stereo transient classification the energy information may be used to identify which channel is transient.

If the decoded CLD is positive, the energy of the left channel is higher than the energy of the right channel, then post-processing may only be applied to the left channel using the weighted mono time envelope. If the decoded CLD is negative, the energy of the left channel signal is smaller than the energy of the right channel signal, then post-processing may only be applied to the right channel using the weighted mono time envelope.

When such an additional decision is based on ITD, both channels may be classified as transient, and one of them with the delay of ITD samples.

According to above definition, if ITD<0, the left channel signal comes firstly. If ITD>0, the right channel signal comes firstly.

If the ITD>0, the weighted mono time envelope may be delayed by ITD samples before applying it to the left channel signal. The time envelope of the right channel signal may be recovered by only using the weighted mono time envelope.

If the ITD<0, the weighted mono time envelope may be delayed by ITD samples before applying it to the right channel signal. The time envelope of the left channel signal may be recovered by only using the weighted mono time envelope.

The weighting factor of both channels may be calculated by using equations above mentioned equations (4) and (5), respectively.

Figure 9:
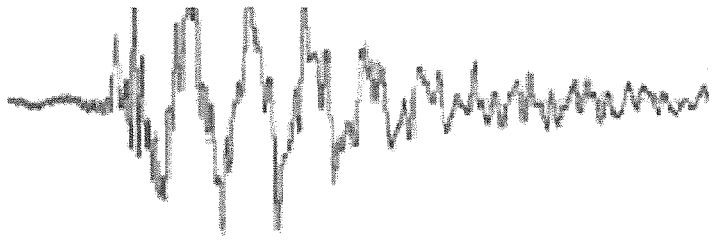
FIG. 9 shows a diagram illustrating an original stereo signal whose two channels are transient.
Figure 9:
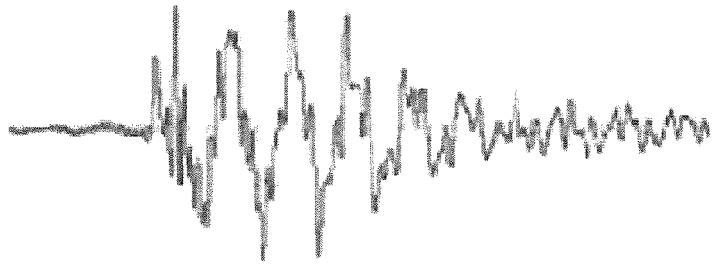
Figure 10:
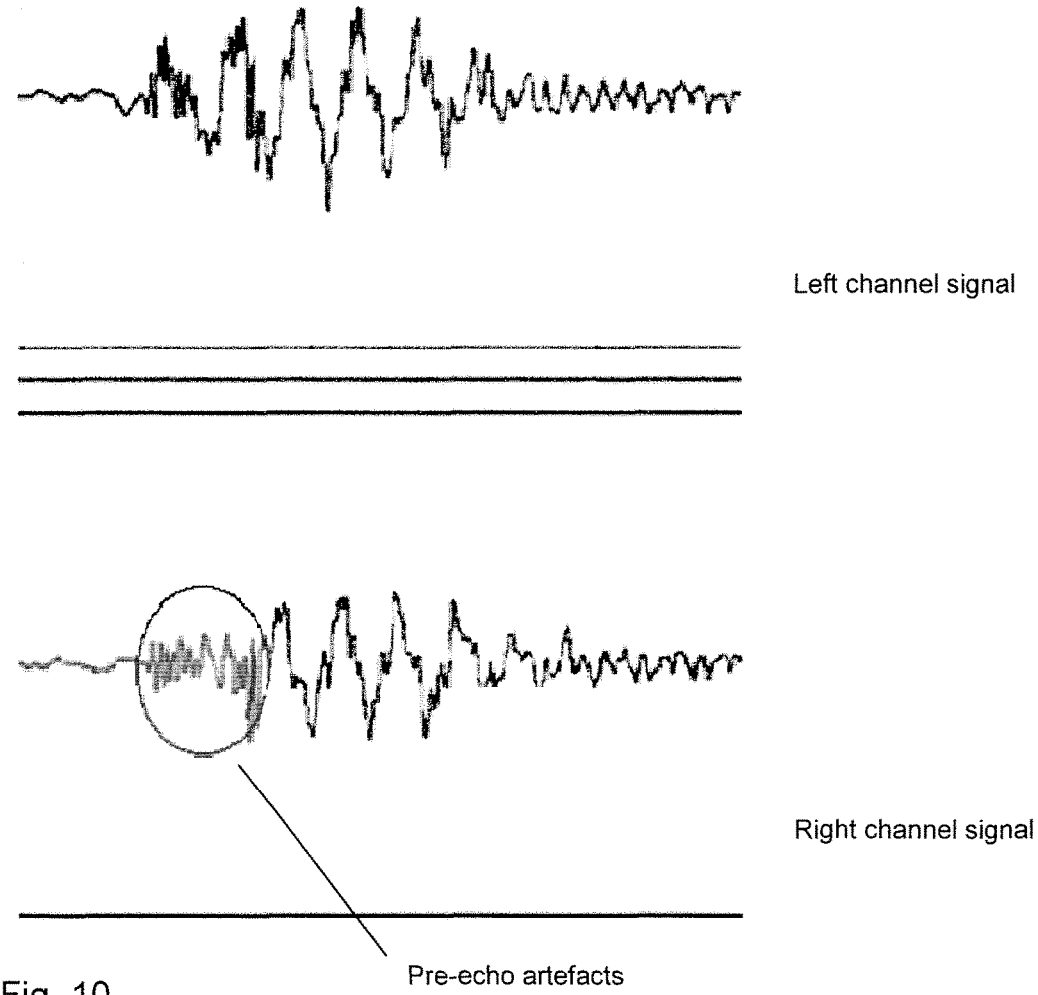
FIG. 10 shows a diagram illustrating the output stereo signal with two post-processed channels using weighted mono time envelopes.
Figure 11:
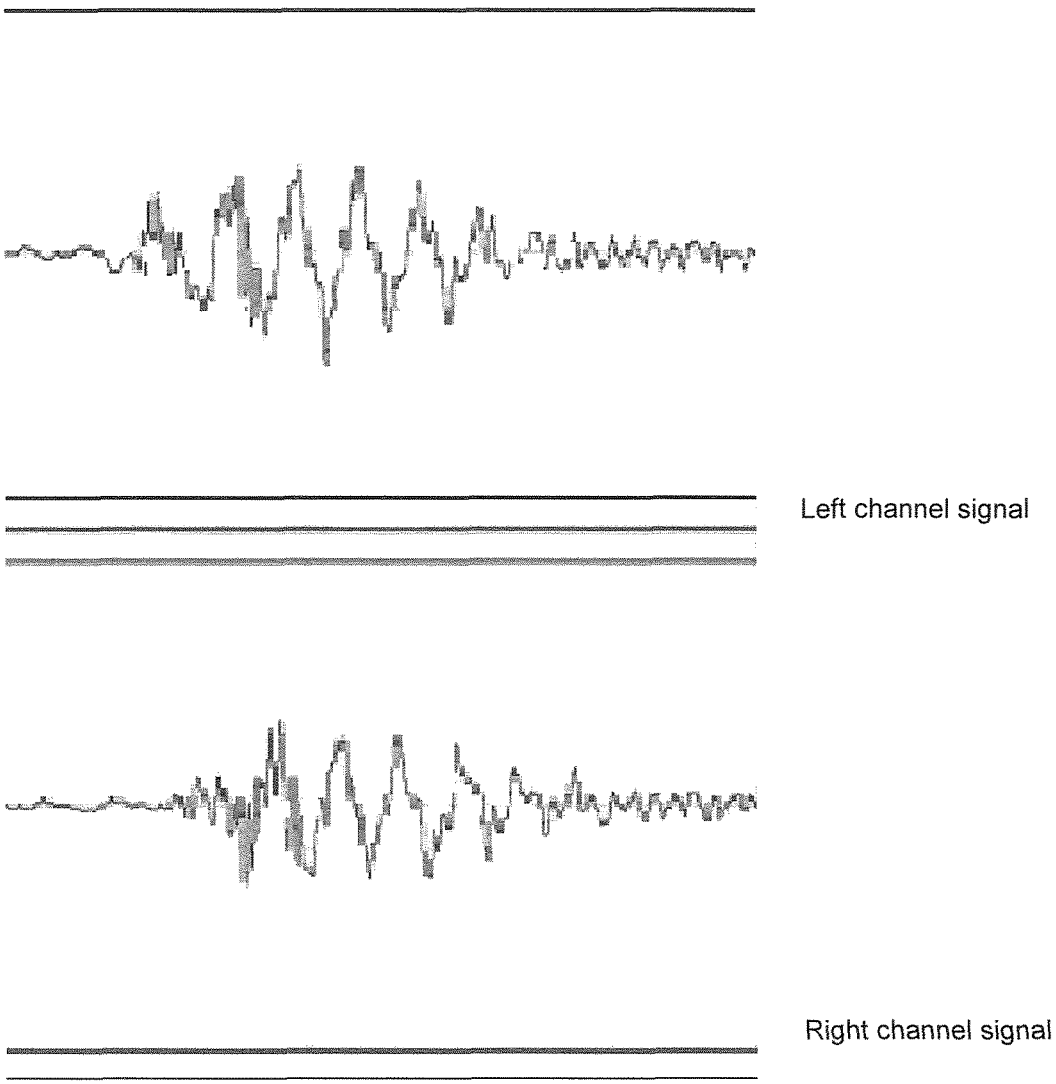
FIG. 11 shows a diagram illustrating the output stereo signal with post-processing based on ITD.

The pre-echo-artifacts of a stereo signal, whose both channels are transient, may be eliminated. In this regard, FIG. 9 depicts an original stereo signal whose both channels are transient. Further, the output stereo signal with two post-processed channels using weighted mono time envelopes (without delaying) is shown in FIG. 10. In FIG. 11, the output stereo signal with post-processing based on ITD is shown. The top charts of FIGS. 9 to 11 depict the left channel signal and the bottom charts depict the right channel signal. As can be seen from FIG. 9, the left channel signal comes firstly, or in other words, the right channel signal is delayed with regard to the left channel signal.

From above FIGS. 9 to 11, it may be derived that if the weighted mono time envelope is directly applied to the left and the right channel signals without delay, obvious pre-echo-artifacts may be observed for the delayed right channel signal, as shown in the circle of FIG. 10. The algorithm described above may improve the situation with a better reconstructed time envelope for both channels (see in particular the improved right channel signal), especially when there is a delay between two channels (see FIG. 11).

Figure 12:
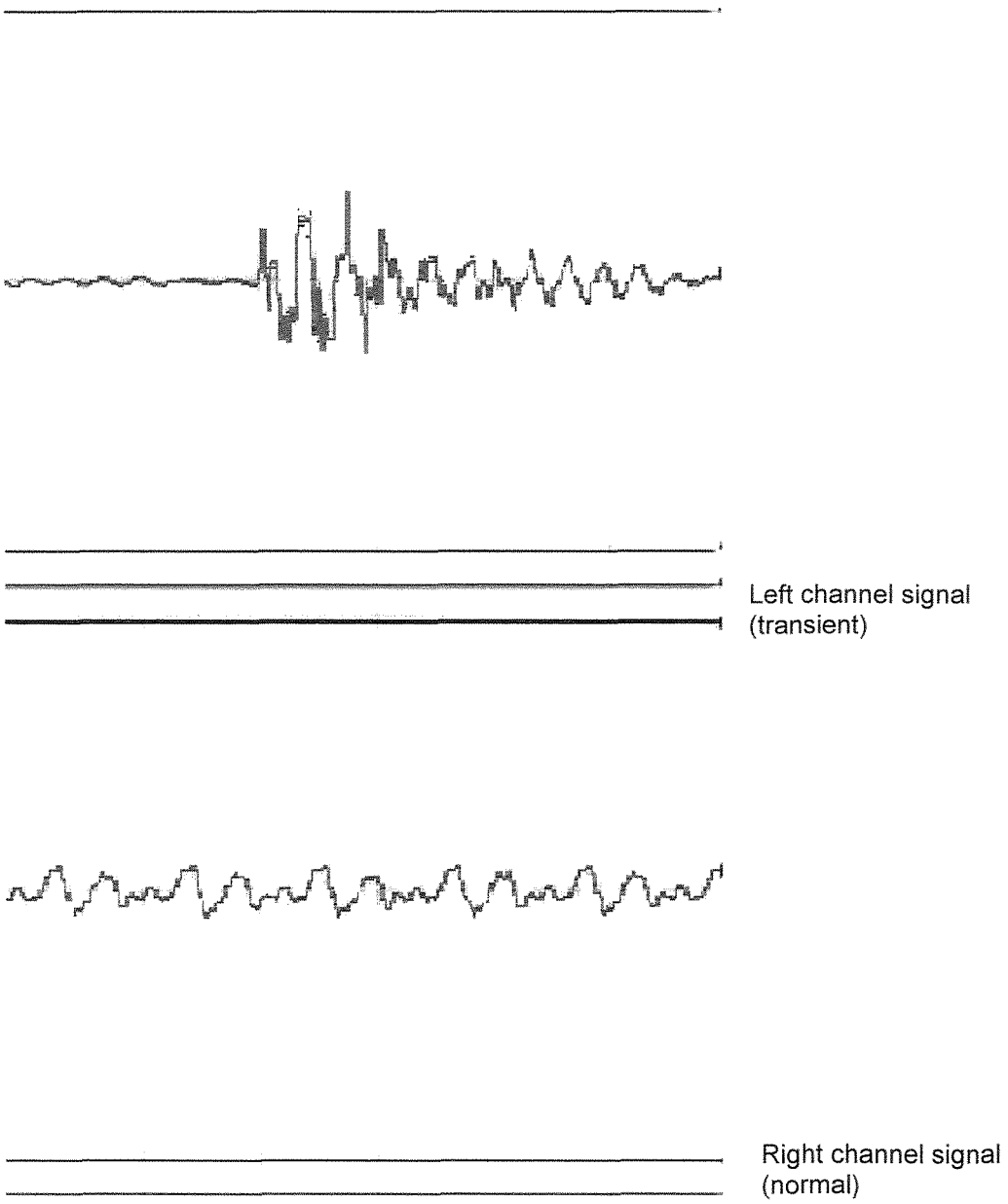
FIG. 12 shows a diagram illustrating an original stereo signal having one transient channel and one normal channel.
Figure 13:
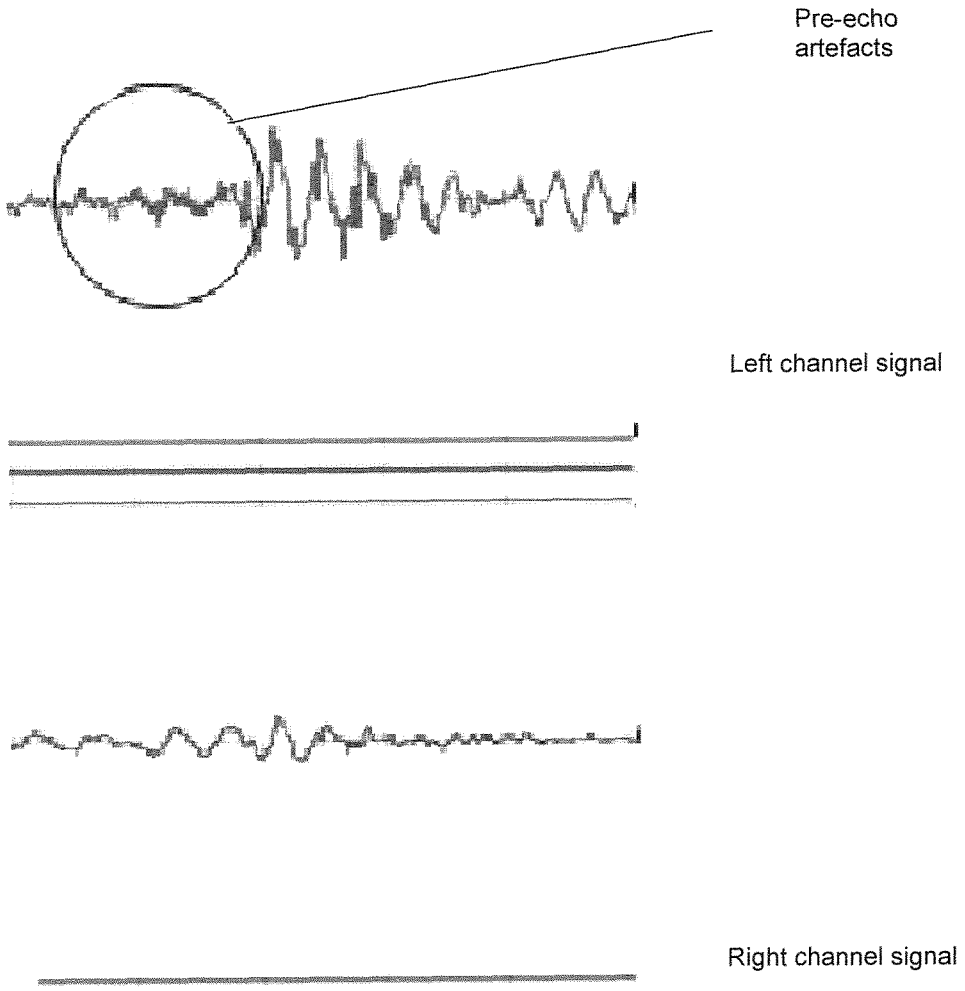
FIG. 13 shows a diagram illustrating the output stereo signal without post-processing.
Figure 14:
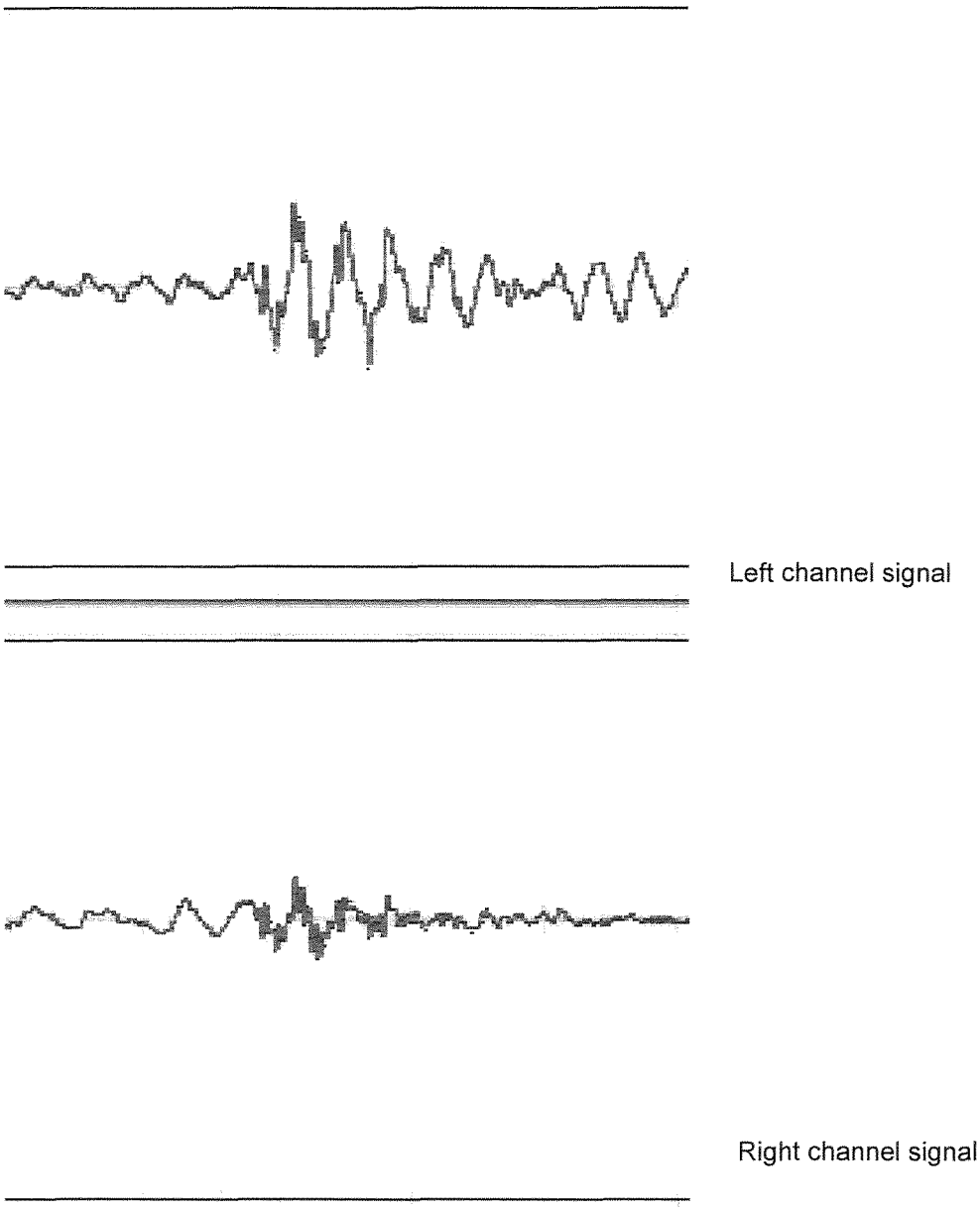
FIG. 14 shows a diagram illustrating the output stereo signal with post-processing for both channels.
Figure 15:
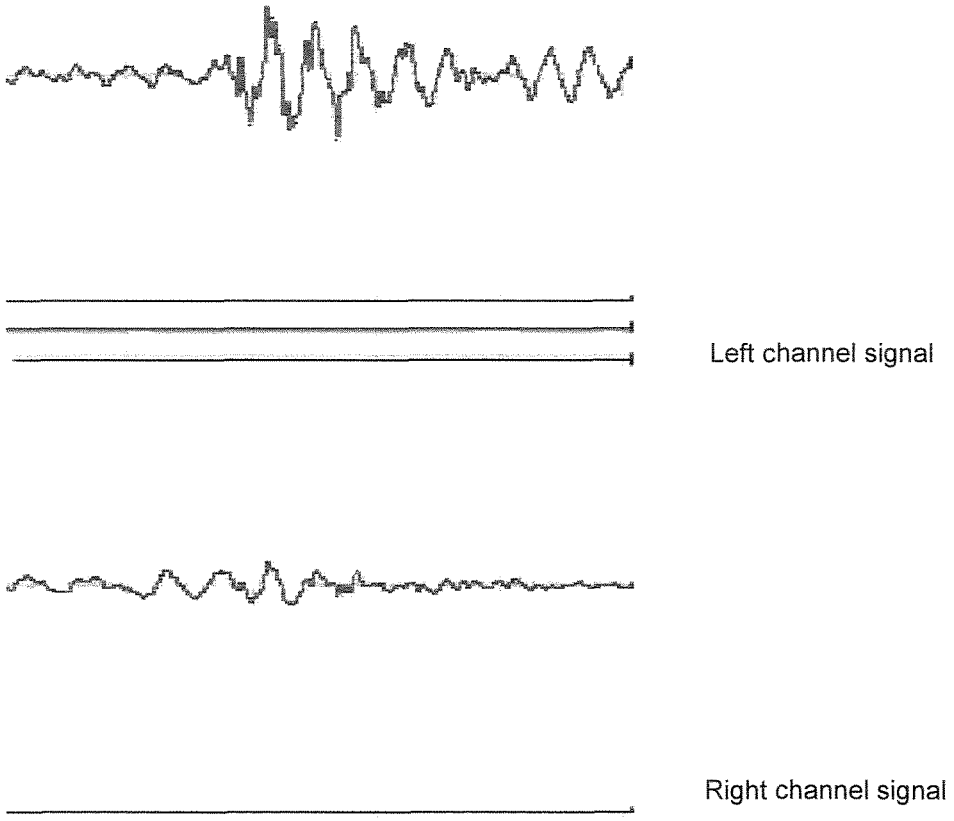
FIG. 15 shows a diagram illustrating the output stereo signal with post-processing only the left channel which is transient.

FIGS. 12 to 15 show performances illustrating that according to implementations of the present invention the pre-echo artefacts of a stereo signal having at least one transient channel may be eliminated. In this regard, FIG. 12 shows a diagram illustrating an original stereo signal having one transient channel (left channel signal, top of FIG. 12) and one normal channel (right channel signal, bottom of FIG. 12), FIG. 13 shows a diagram illustrating the output stereo signal without post-processing, FIG. 14 shows a diagram illustrating the output stereo signal with post-processing for both channels, and FIG. 15 shows a diagram illustrating the output stereo signal with post-processing only the left channel which is transient. The top charts of FIGS. 12 to 15 depict the left channel signal and the bottom charts depict the right channel signal.

With respect to FIG. 13, if no post-processing is applied to the reconstructed stereo signal, obvious pre-echo artifacts may be observed in the left channel signal (see the circle of FIG. 13). If post-processing is applied to both channels, noise may be found in the right channel (see the circle in FIG. 14). If post-processing is only applied to the left channel signal (without delaying) the pre-echo artifacts in the left channel signal are at least reduced or even completely eliminated.

Therefore, as can be seen from FIGS. 9 to 15, the present algorithm may improve the situation with a better reconstructed time envelope for both channels in all the combinations of transient signals, i.e. left and right channels, only left channel, or only right channel.

Figure 16:
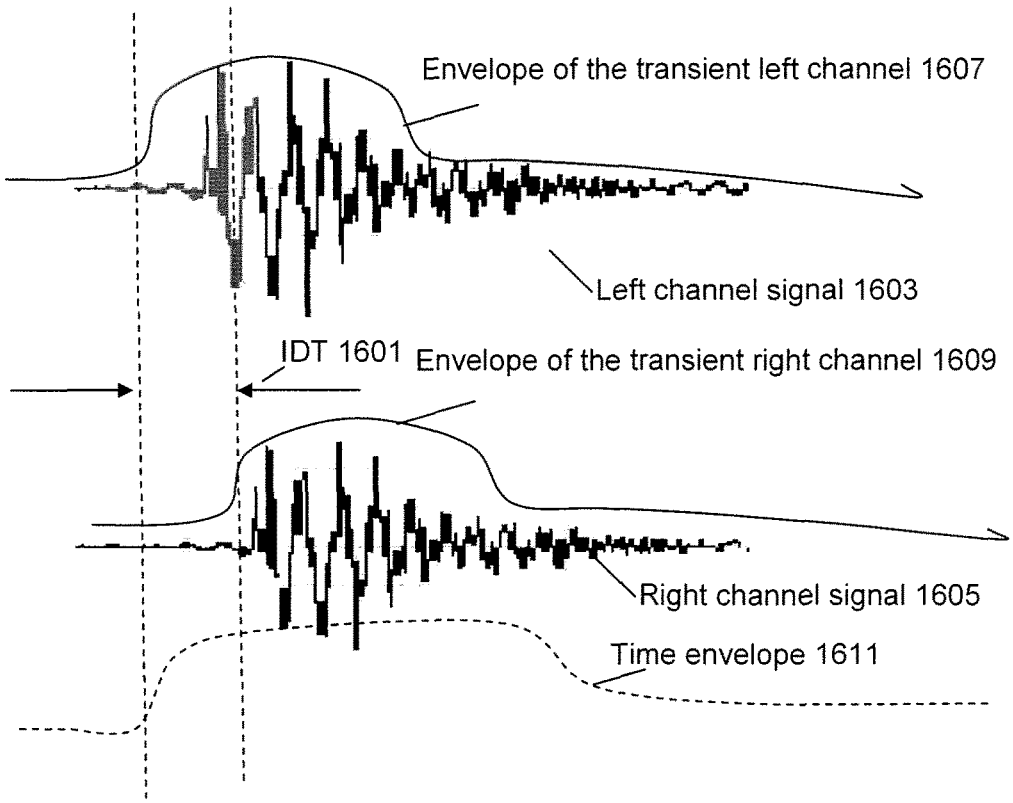
FIG. 16 shows a diagram illustrating an ITD between a left channel signal and a right channel signal.

FIG. 16 shows a diagram illustrating an ITD 1601 between a left channel signal 1603 and a right channel signal 1605.

Further, FIG. 16 shows a time envelope 1607 of the left channel signal 1603 and a time envelope 1609 of the right channel signal 1605. The ITD 1601 may be calculated as described in reference [4]. Moreover, FIG. 16 shows a time envelope 1611 of the downmix signal generated from the left channel signal 1603 and the right channel signal 1605. As can be seen from FIG. 16, the beginning of the envelope of the transient left channel 1607 signal coincides with the beginning of the time envelope 1611 of the downmix signal. In other words, the time envelope of the transient left channel signal can be recovered without delaying the envelope signal of the downmix signal. However, as can be also seen from FIG. 16, the beginning of the envelope of the transient right channel 1609 signal is delayed with regard to the beginning of the time envelope 1611 of the downmix signal, wherein the delay corresponds to the delay between the left and right channel signal. Thus, using the time envelope signal of the downmix signal for recovering the time envelope of the right channel signal without delaying the time envelope of the downmix signal leads to pre-echo artifacts. Using the time envelope signal of the downmix signal for recovering the time envelope of the right channel signal with delaying the time envelope of the downmix signal reduces the pre-echo artifacts. Any delay of the time envelope of the downmix signal that reduces the time difference between the time envelope of the delayed right channel signal and the time envelope of the downmix signal already reduces the pre-echo artifacts compared to applying no delay, and, thus improves the quality of the reconstructed right channel signal. A delay of the time envelope of the downmix signal by the interchannel time difference ITD, e.g. by the number of samples specified by the ITD, reduces the pre-echo artifacts compared to applying no delay to a minimum, and, thus improves the quality of the reconstructed right channel signal most.

Figure 17:
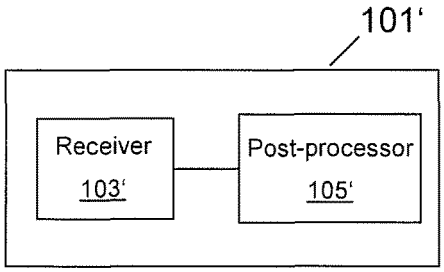
FIG. 17 shows an embodiment of a device for post-processing a decoded multi-channel signal.

In FIG. 17, an embodiment of a device 101' for post-processing a decoded multi-channel signal processed by a low-bit-rate audio coding system is illustrated. The device 101' is adapted to post-process at least one channel signal of a plurality of channel signals of the multi-channel signal, the at least one channel signal being generated from a decoded downmix signal by the low-bit-rate audio coding/decoding system. As explained, the downmix signal, in its encoded and decoded version, represents the multi-channel signal.

The device 101' has a receiver 103' and a post-processor 105'.

The receiver 103' is configured to receive at least one channel signal of a plurality of M channel signals of the multi-channel signal, the at least one channel signal being generated from the decoded downmix signal, a time envelope of the decoded downmix signal, an interchannel time difference (ITD) between the at least channel signal and the downmix signal, and at least a classification indication indicating a transient type of the downmix signal.

The post-processor 105' is adapted to post-process the at least one channel signal based on the time envelope of the decoded downmix signal weighted by a weighting factor and in dependence on the classification indication and the interchannel time difference (ITD). The classification indication is used by the post-processor to control, whether the at least one channel signal is post-processed. The ITD can be used by the post-processor to determine, whether to delay the time envelope of the downmix signal for the post-processing of the at least one channel signal.

The plurality M is larger than one, i.e. M>1. In the following m is used as index to describe a particular channel signal of the plurality M of channel signals.

A further embodiment can comprise a receiver 103' configured to receive some or all of the plurality of channel signals of the multi-channel signal, each of the channel signals being generated from the decoded downmix signal, a time envelope of the decoded downmix signal and an interchannel time difference for each of the channel signals (or at least for each of a subset of the channel signals), each of the channel specific interchannel time differences indicating a delay of the corresponding channel signal with regard to the downmix signal. The ITD may range from negative values to positive values including zero. Zero (ITD=0) indicates that the channel signal has a delay of zero, e.g. zero samples. In other words ITD=0, indicates that the channel signal m is delayed by zero, i.e. in fact is not delayed, with regard to the downmix signal. The post-processor 105' of the further embodiment is adapted to post-process the at least one channel signal of the plurality of channel signals based on a weighted time envelope of the decoded downmix signal and in dependence on the classification indication of the downmix signal and the interchannel time difference. The classification indication is used to control, whether the plurality of channel signals is post-processed. The channel specific ITD can be used to determine, whether to delay the time envelope of the downmix signal for the post-processing of the at least one channel signal.

An even further embodiment can comprise a receiver 103' configured to receive additionally a classification indication for each of the channel signals (or at least for each of a subset of the channel signals), each of the channel specific classification indications indicating a respective transient type of the corresponding channel signal. The post-processor 105' of the further embodiment can be adapted to post-process at least one channel signal of the plurality of channel signals based on a weighted time envelope of the decoded downmix signal and in dependence on the downmix classification indication indicating a transient type of the downmix signal and the further or additional channel classification indication indicating a transient type of the respective channel signal. The downmix classification indication and the further channel classification indication can be used to control, which of the plurality of channel signals is post-processed. Furthermore, the decider can be adapted to control the post-processor dependent on the channel specific interchannel time difference, whether to apply a delayed weighted time envelope for the post-processing of the respective channel signal.

According to a further embodiment, the device further comprises a decider. The decider is adapted to receive the classification indication identifying a transient type of the downmix signal and the interchannel time difference (optionally also the channel specific further classification indication indicating a transient type of the channel), and to control the post-processor dependent on the classification indication (optionally additionally dependent on the further classification indication), whether to post-process the at least one channel signal using the channel specifically weighted time envelope, and dependent on the interchannel time difference, whether to apply a delayed weighted time envelope.

In another embodiment, the post-processor 105' is adapted to receive the time envelope of the decoded downmix signal and a channel specific weighting factor, and to generate the weighted time envelope by multiplying the time envelope with the channel specific weighting factor.

Embodiments of the post-processor may comprise only one post-processing entity adapted to post-process one, several or all of the channel signals. The decision which of the plurality of the channel signals is post-processed is controlled by the decider. Other embodiments may comprise more than one post-processing entity, e.g., for each channel signal a dedicated post-processing entity or post-processing entities adapted to post-process more than one channel signal according to the control of the decider.

Figure 18:
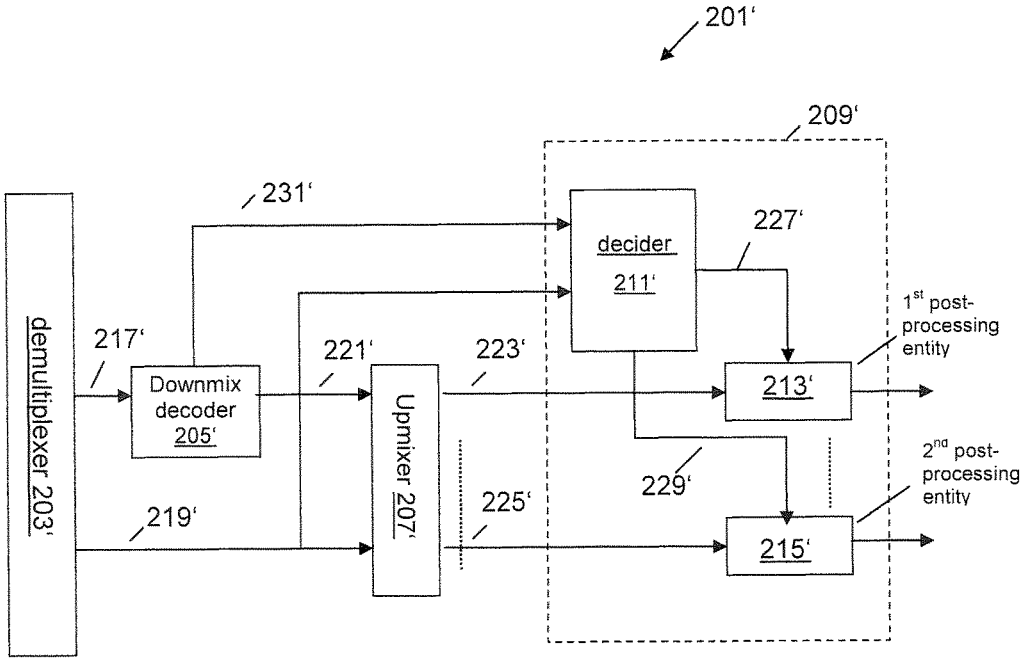
FIG. 18 shows a third embodiment of a decoder including a device for post-processing a decoded multi-channel signal.

FIG. 18 shows a third embodiment of a decoder 201', i.e. a decoder for parametric multi-channel audio decoding. The decoder 201' has a demultiplexer 203', a downmix decoder 205', an upmixer 207' and a device 209' for post-processing. The device 209' for post-processing has a decider 211', a first processing entity 213' and a second post processing entity 215'.

The demultiplexer 203' is adapted to receive a multiplexed audio signal comprising the downmix signal and the multi-channel parameters, and to demultiplex the received signal, e.g. the received bitstream, to output the received downmix signal 217', e.g. downmix bitstream 217', and the multi-channel audio coding parameters 219' associated to the received downmix signal 217'. The multi-channel audio coding parameters 219' include the interchannel time difference (ITD) and a channel level difference (CLD) for each of the channel signals of the multi-channel signal represented by the downmix signal. The channel specific interchannel time difference (ITD) will also be referred to as $ITD_m$, and the channel specific channel level difference will also be referred to as $CLD_m$, wherein m represents the channel index specifying a channel of the plurality M of channel signals of the multi-channel signal.

The downmix decoder 205' is configured to receive the encoded downmix signal 217' and to provide a decoded downmix signal 221' to the upmixer 207' and to the device 209' for post-processing.

The upmixer 207' is adapted to receive the decoded downmix signal 221' and the channel specific channel level differences $CLD_m$, and to generate as output based on the aforementioned decoded downmix signal 221' and the channel-specific $CLD_m$ the M channel signals of the multi-channel signal (indicated by the exemplary two reference signs 223' and 225'). The dots between the signal lines referenced with reference numbers 223' and 225' indicate that the multi-channel signal can have more than M=2 channel signals.

The decider 211' of the device 209' is configured to receive a signal 231' including the time envelope of the decoded downmix signal and a classification indication indicating the transient type of the decoded downmix signal. The classification indication indicates whether the decoded downmix signal is transient or normal, e.g. not transient. The decider 211' of the device 209' is further adapted to receive channel specific interchannel time differences $ITD_m$, channel specific channel level differences $CLD_m$ and the channel specific classification information (see signal 219).

The decider 211' is configured to decide which one or ones of the plurality M of channel signals 223', 225' are post-processed. The decider 211', in other words, is configured to decide, whether none of the channel signals is post-processed, whether all of the M channel signals are post-processed, or if only a subset of the channel signals is post-processed. The decider 211' is configured to decide dependent on the classification indication indicating for each of the channel signals a transient type of the respective channel signal, i.e. indicating for each of the channel signals whether the respective channel signal is transient or normal. This classification indication may be included in the signal 219'. The decider is also adapted to decide, whether post-processing of a channel signal m is to be performed using a delayed version of the time envelope of the downmix signal.

Further, the decider 211' can be configured to control the post-processing entities 213', 215' by means of respective control signals. In FIG. 14, the control signal 227' for controlling the post-processing entity 213' is shown and the control signal 229' for controlling the post-processing entity 215'. The post-processing entity 213' is configured to post-process the channel signal 223' using the received time envelope 231' of the decoded downmix signal, wherein the time envelope is weighted by a channel specific weighting factor associated to the channel signal 223', and channel specifically delayed, if indicated so by the corresponding $ITD_m$.

In an analogous way, the post-processing entity 215' is configured to post-process the channel signal 225' using the received time envelope 231' of the decoded downmix signal, wherein the time envelope is weighted by a channel specific weighting factor associated to the channel signal, and channel specifically delayed, if indicated so by the corresponding $ITD_m$.

The decider 211' can be configured to calculate or determine the weighting factor associated to the channel signal 223' and the weighting factor associated to the channel signal 225' dependent on the respective received channel level difference $CLD_m$ 219'.

Figure 19:
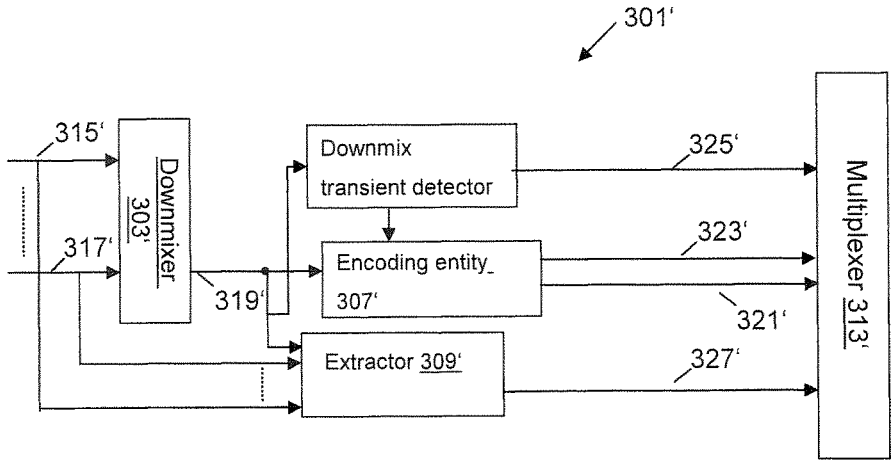
FIG. 19 shows a third embodiment of an encoder couple-able with the decoder of FIG. 18.

With regard to FIG. 18, FIG. 19 shows a third embodiment of an audio encoder, e.g. a parametric multi-channel audio encoder 301' for providing the encoded multi-channel audio signal to be decoded by the decoder of FIG. 18. The encoder 201' of FIG. 18 can be connected to the encoder 301' of FIG. 19 by a transmission channel, for example, a wired or wireless communication link.

The encoder 301' has a downmixer 303', a downmix transient detector 305', an encoding entity 307', an extractor 309' and a multiplexer 313'.

The downmixer 303' receives the plurality M of channel signals of the multi-channel signal. For simplicity purposes, in FIG. 19 only two representative channel signals 315' and 317' of the plurality M of channel signals are shown. The downmixer 303' is further adapted to generate and output a downmix signal 319', the downmix signal 319' being provided to the downmix transient detector 305' and to the downmix encoding entity 307'. Optionally, in case the downmix signal is used as reference signal for determining the channel transient classification of the channel signals and/or the channel level difference CLD for the channel signals, the downmix signal may also be provided to the extractor 309'.

The downmix transient detector 305' is adapted to detect whether the downmix signal is transient or not, and to output a classification indication 325' indicating whether the downmix signal 319' is transient or not. The downmix transient detector can be adapted to evaluate the energy of consecutive frames of the downmix signal and to detect that the downmix signal is transient when a change of the energy of the downmix signal from one frame to a consecutive frame exceeds a predetermined threshold.

As for this detection the dynamics or change over time of the downmix signal itself is evaluated (in contrast to the stereo transient classification and the channel transient classification, where the dynamics of the energy of two signals are evaluated) this transient classification is also referred to as downmix transient classification and the downmix signal is also referred to as being downmix transient in case the above condition is fulfilled, e.g. the change of the energy of the downmix signal from one frame to a consecutive frame exceeds the predetermined threshold.

Therefore the classification indication 325 'indicating a transient type of the downmix signal, which is output by the downmix transient detector 305', can also be referred to as downmix transient classification indication or as transient classification indicating a downmix transient type of the downmix signal, i.e. indicating whether the downmix signal is downmix transient or not.

The encoding entity 307' is adapted to output the encoded downmix signal 321' and a time envelope 323' of the downmix signal, e.g. as part of the downmix signal 321'. The encoding entity 307' can be adapted to extract the time envelope of the downmix signal only in case the downmix transient detector detects that the downmix signal is downmix transient. The encoding entity can be adapted, e.g. to divide the whole frame into four sub-frames, to calculate the energy of each sub-frame and to encode the square roots of energy of those four sub-frames to represent the time envelope of the downmix signal.

Like the time envelope 323', the classification indication 305' is sent together with the downmix signal, e.g. as part of it, to the decoder.

The extractor 309' is configured to receive the M channel signals of the multi-channel signal and to extract for each channel m of the multi-channel signal a channel specific interchannel time difference $ITD_m$, a channel specific channel level difference $CLD_m$ and other multi-channel audio coding parameters from the multi-channel signal. The extracted $ITD_m$, $CLD_m$ and the other multi-channel coding parameters from the multi-channel signal are transferred by a signal 327' as side information to the decoder.

The extractor 309' is further adapted to provide a channel transient detection for each of the channel signals and to output for each of the channel signals a channel specific classification indication indicating the transient type of the respective channel signals by the signal 327' as side information to the decoder. Therefore, the extractor 309' can also be referred to as detector 309'.

The extractor 309' can be implemented to calculate a channel level difference $CLD_m$ for each channel signal m for consecutive frames of the multi-channel signal, and to detect that the channel signal m is transient, in case a change of the CLD associated to the channel signal m, e.g. the CLD calculated between the channel signal m and a reference signal, from one frame to a consecutive frame exceeds a predetermined threshold. The reference signal can be the downmix signal of the multi-channel signal, any of the channel signals or any other signal derived from at least one of the channel signals, e.g. an additional downmix signal generated from a subset of the plurality of channel signals.

As for this detection the dynamics or change over time of the relation of the energies of the actual channel signal m and the reference signal, i.e. of two signals, is evaluated (in contrast to the downmix transient classification and the mono transient classification, where the dynamics of the energy of only one signal is evaluated) this transient classification is also referred to as channel transient classification to distinguish it from the mono or downmix transient classification and the stereo transient classification. Accordingly, the channel signal is also referred to as being channel transient in case the above condition is fulfilled, e.g. the change of the $CLD_m$ associated to the channel m signal from one frame to a consecutive frame exceeds a predetermined threshold.

Therefore, the extractor 309 may also be referred to as channel transient detector 309 and the classification indication indicating a transient type of the channel signal can also be referred to as channel transient classification indication or classification indication indicating a channel transient type of the channel signal, i.e. indicating whether the channel signal is channel transient or not.

According to an embodiment, the downmix transient detector 305' is adapted to control (see arrow from 305' to 307') the encoding entity 307' such that the encoding entity only determines a time envelope 323' of the downmix signal in case the downmix transient detector 305' detects that the downmix signal is downmix transient.

In alternative embodiments, the encoding entity 307' can be adapted to determine the time envelope 323' independent of, whether the downmix transient detector has detected that the downmix signal is downmix transient.

FIGS. 18 and 19 show embodiments for mono downmix coding. Therefore, the encoder (FIG. 19) comprises a mono downmixer 303', adapted to downmix the plurality of channel signals to only one single mono downmix signal 319', a mono downmix encoding entity 307' adapted to encode the mono downmix signal 319', and a mono transient detector 305' to detect whether the mono downmix signal is mono transient or not. Correspondingly, the decoder (FIG. 18) comprises a mono downmix decoder 205' adapted decode the received encoded mono downmix signal 205', and a mono upmixer 207' adapted to generate the plurality of M channel signals 213', 215' from the one decoded mono downmix signal 221'.

Alternative embodiments of the encoder and decoder can be implemented to perform multiple or stereo downmix coding, e.g. can be implemented to downmix a multi-channel signal such that the multi-channel signal is represented by two or more downmix signals (but typically less than M) and corresponding sets of spatial audio parameters to be able to reconstruct the channel signals from the more than two downmix signals. Each downmix signal is derived from at least two of the more than two channel signals of the multi-channel signal. In such embodiments, the encoder comprises a downmixer adapted to downmix the plurality of channel signals to the two or more downmix signals, one or more downmix encoding entities adapted to encode the downmix signals, and one or more downmix transient detectors adapted to detect at least whether one of the downmix signals is downmix transient or not. Correspondingly, the decoder comprises one or more downmix decoders adapted decode the received encoded downmix signals, an upmixer 207' adapted to generate the plurality of M channel signals 213', 215' from the two or more decoded downmix signals, and a decider adapted to evaluate for at least one of the downmix signals whether it is classified as downmix transient or not.

Figure 20:
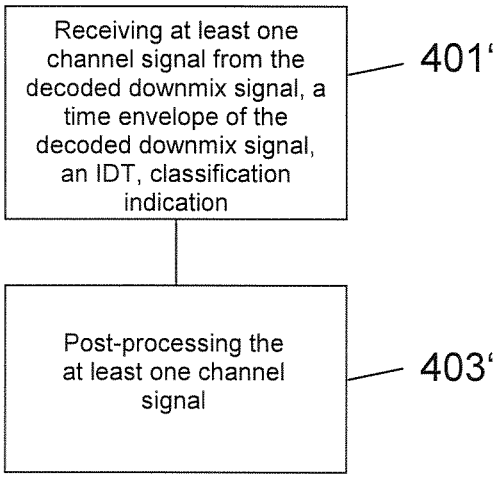
FIG. 20 shows a first embodiment of a method for post-processing a decoded multi-channel signal.

FIG. 20 shows a flow chart of a first embodiment of a method for post-processing a decoded multi-channel signal. The method for post-processing is adapted to post-process at least one channel signal of a plurality of channel signals of the multi-channel signal, the at least one channel signal being generated from a decoded downmix signal by a low-bit-rate audio coding/decoding system. As explained, the downmix signal, in its encoded and decoded version, represents the multi-channel signal. The method comprises the following steps.

Receiving 401' the at least one channel signal generated from the decoded downmix signal, a time envelope of the decoded downmix signal, an interchannel time difference between the channel signal and the downmix signal, and a classification indication indicating a transient type of the downmix signal, wherein the interchannel time difference is associated to the at least one channel signal.

Post-processing 403' the at least one channel signal based on the time envelope of the decoded downmix signal weighted by a respective weighting factor and in dependence on the classification indication and the interchannel time difference.

Figure 21:
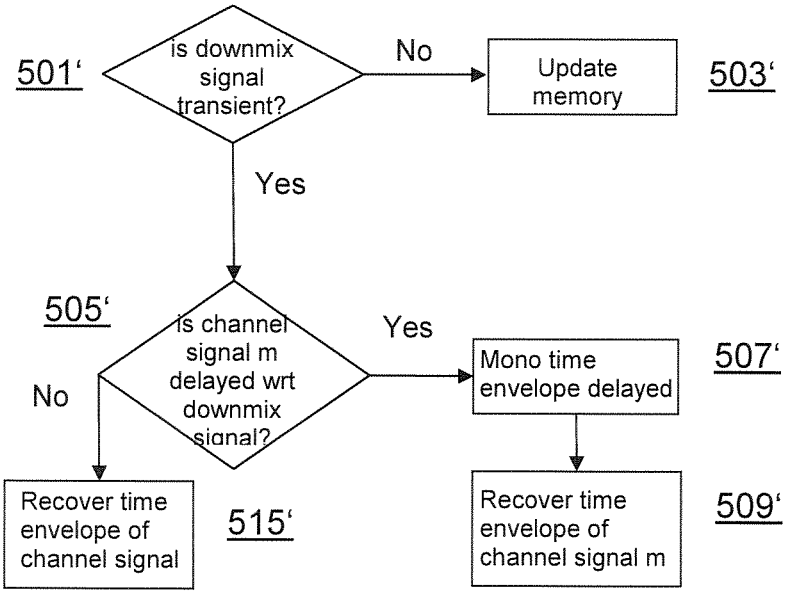
FIG. 21 shows a second embodiment of a method for post-processing a decoded multi-channel signal.

FIG. 21 shows a flow chart of a second embodiment of a method for post-processing a decoded multi-channel signal, wherein the downmix signal is used as reference signal. The method for post-processing is adapted post-process at least one channel signal of a plurality of channel signals of the multi-channel signal, the at least one channel signal being generated from the decoded downmix signal by a low-bit-rate audio coding/decoding system. As explained, the downmix signal, in its encoded and decoded version, represents the multi-channel signal. The method comprises the following steps Step 501' comprises checking whether the downmix signal is transient or not.

In case the downmix signal is not transient, e.g. only the memory is updated in step 503'. No post-processing of any of the multi-channel signals using the channel specifically weighted time envelopes of the downmix signal is performed. As the downmix signal is typically transient if at least one of the channel signals of the multi-channel signal from which it was derived is transient, it can be assumed that in case the classification indicator indicating the transient type of the downmix signal indicates that the downmix signal is not transient, i.e. the downmix signal is not downmix transient, none of channel signals is transient, and, therefore no post-processing is required.

If the decoded downmix signal is transient the method proceeds with step 505'.

In step 505', it is checked, which of the channel signal m and the downmix signal comes firstly. Or, in other words, in step 505', it is checked based on the interchannel time difference (ITD), whether the channel signal is delayed with regard to the downmix signal.

The ITD or Interchannel Time Difference represents the delay between two channel signals and can be extracted from any of two signals of the multi-channel signal, or for any channel signal m and a reference signal of the multi-channel signal, e.g. the downmix signal as used here. In the embodiment described in FIG. 21, the ITD of a channel signal m with regard to the downmix signal is determined, e.g. at the encoder, and evaluated at the decoder. The ITD expresses the delay typically as number of samples and can be, for example, calculated based on the following equation:

$$ITD = \arg\max_{d} \{IC(d)\},$$

with IC(d) being the normalized cross-correlation defined as $$IC[d] = \frac{\sum_{n=0}^{N-1} x_1[n]x_2[n-d]}{\sqrt{\sum_{n=0}^{N-1} x_1^2[n] \sum_{n=0}^{N-1} x_2^2[n]}},$$

wherein $x_1$ and $x_2$ represent the first signal and second signal to be correlated, d represents the delay or time difference, n represents the time index and N represents the maximum time index.

It should be noted that this cross-correlation can be computed on a band per band basis. In order to avoid a false detection of ITD, the maximum correlation may be compared with a threshold. If the maximum correlation is higher than the threshold, the detected delay corresponds to the ITD. Otherwise, the detected delay may not represent an ITD, and to avoid introducing a wrong ITD, its value is changed to 0. Thus, ITD=0 may signify that the transient channel signal and the transient downmix signals have no delay with regard to each other, or that the similarity (i.e. correlation) of the two signals was not sufficiently significant.

Alternatively, the ITD may be calculated on other cross-correlations, e.g. non-normalized cross correlations. In addition, e.g., phase difference computations can also be used to estimate the interchannel time difference as presented in "Estimation of Interchannel Time Difference in Frequency Subbands Based on Nonuniform Discrete Fourier Transform", Bo Qiu, Yong Xu, Yadong Lu, and Jun Yang, EURASIP Journal on Audio, Speech, and Music Processing, Volume 2008 (2008).

For the multi-channel signal, if $x_1$ and $x_2$ correspond to the downmix signal and the channel signal m respectively, ITD<0 means that the downmix signal comes first (i.e. the channel signal m is delayed with regard to the downmix channel signal) and ITD>0 means that the downmix signal is delayed compared to the channel signal m. Of course a different convention can be adopted for the ITD computation. In that case, the comparison with the threshold 0 is inverted. That is, if $x_1$ and $x_2$ correspond to the channel signal m and the downmix signal respectively, ITD<0 means that the channel comes first m (i.e. the downmix signal is delayed with regard to the channel signal m) and ITD>0 means that the channel signal m is delayed compared to the downmix signal. ITD=0 means, for both of the above calculations of the cross correlation, that both signals, the downmix signal and the channel signal m are not delayed with regard to each other or are not sufficiently similar.

Using the above equations for calculating the ITD, in case $x_1$ corresponds to the downmix signal and $x_2$ corresponds to the channel signal m, it is defined, that if ITD<0, the downmix signal comes firstly, and if ITD>0, the channel signal m comes firstly. An example for calculating the ITD is described in more detail in reference [4].

Based on the aforementioned calculation of the ITD ($x_1$ corresponds to the downmix signal and $x_2$ corresponds to the channel signal m), it is evaluated in step 505', whether the ITD is smaller than 0, i.e. ITD<0. If the ITD<0 (i.e. the channel signal m is delayed with regard to the downmix signal), the method proceeds with step 507'.

In the step 507, the mono time envelope is delayed by ITD samples for post-processing the channel signal m.

Then, in step 509, the time envelope of the channel signal m is recovered using the delayed and weighted mono time envelope.

If in step 505' the result is that the ITD is not smaller than 0, i.e. ITD>0 (this includes the case ITD>0, i.e. downmix signal is delayed with regard to the channel signal m, and the case ITD=0, i.e. no delay between the two signals), then the method proceeds with step 515'.

Then, according to FIG. 21, in step 515', the time envelope of the channel signal is recovered using the weighted mono time envelope without delay.

Alternative embodiments may comprise evaluating at step 505', whether (1) the ITD>0, (2) ITD<0, and (3) ITD=0, and may perform the post-processing of the channel signal m with a (undelayed) weighted time envelope of the downmix signal in cases (1) and (3) and may perform the post-processing of the channel signal m with a delayed weighted time envelope of the downmix signal in case (2).

Examples for calculating the respective weighting factor for weighting the time envelope of the decoded downmix signal are shown above.

Figure 22:
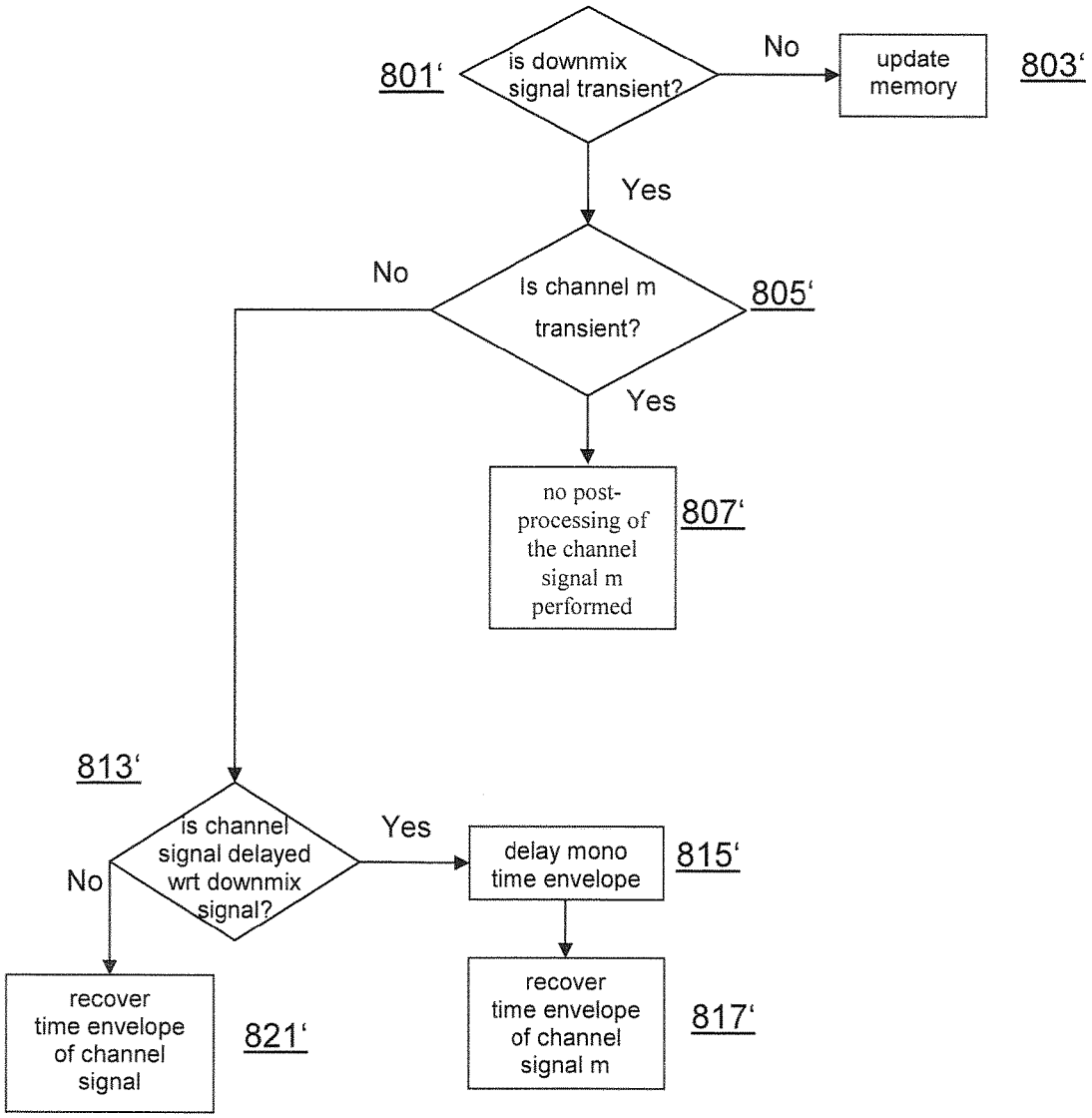
FIG. 22 shows a third embodiment of a method for post-processing a decoded multi-channel signal.

FIG. 22 shows a flow chart of a third embodiment of a method for post-processing a decoded multi-channel signal, wherein the downmix signal is used as reference signal. The method for post-processing is adapted post-process at least one channel signal of a plurality of channel signals of the multi-channel signal, the at least one channel signal being generated from the decoded downmix signal by a low-bit-rate audio coding/decoding system. As explained, the downmix signal, in its encoded and decoded version, represents the multi-channel signal. The method comprises the following steps Step 801' comprises checking whether the downmix signal is transient or not.

In case the downmix signal is not transient, e.g. only the memory is updated in step 803'. No post-processing of any of the multi-channel signals using the channel specifically weighted time envelopes of the downmix signal is performed. As the downmix signal is typically transient if at least one of the channel signals of the multi-channel signal from which it was derived is transient, it can be assumed that in case the classification indicator indicating the transient type of the downmix signal indicates that the downmix signal is not transient, i.e. the downmix signal is not downmix transient, none of channel signals is transient, and, therefore no post-processing is required.

If the decoded downmix signal is transient the method proceeds with step 805'. Step 805' comprises checking, whether channel m is transient or not. The channel transient classification indication can be regarded as an indicator, whether the channel m has a different dynamic compared to the reference signal, i.e. whether the channel signal m and the reference signal have a different course over time. As the relation of the course of the channel signal m and the reference signal is evaluated, e.g. based on the CLD, the channel signal will, typically, be classified as channel transient in case only one of both signals is transient or both are transient but not in the same or similar way, e.g. the energy of the channel signal m and of the reference channel signal change over time in different directions (increase or decrease) or by a different amount. The degree of the difference necessary for a channel signal to be classified as channel transient depends on the metric used, e.g. energy, and the predetermined threshold. In view of the aforementioned, in case the downmix signal is classified as downmix transient (see step 801') and the channel signal is not channel transient, it is assumed that both signals, the channel signal m and the reference signal, are transient in a similar manner. Furthermore, in view of the aforementioned, in case the downmix signal is classified as downmix transient (see step 801') and the channel signal is channel transient, it is assumed that the channel signal m is not transient.

In case the channel signal m is channel transient, the method proceeds with step 807', where no post-processing of the channel signal m is performed.

However, in case the channel signal m is not channel transient, the method proceeds with step 813' and channel m is post-processed using the time envelope of the downmix signal weighted by the channel specific weighting factor and potentially delayed by the ITD.

Steps 813' to 821' correspond to steps 505' to 515' of FIG. 21.

Therefore, in step 813', similar to step 505' of FIG. 21, it is checked, which one of the channel signal m and the downmix signal comes firstly. Or, in other words, in step 505', it is checked based on the interchannel time difference (ITD), whether the channel signal is delayed with regard to the downmix signal.

Based on the calculation of the ITD given with regard to FIG. 21 ($x_1$ corresponds to the downmix signal and $x_2$ corresponds to the channel signal m), it is evaluated in step 813', whether the ITD is smaller than 0, i.e. ITD<0. If the ITD<0 (i.e. the channel signal m is delayed with regard to the downmix signal), the method proceeds (yes) with step 815'.

In the step 815', the mono time envelope is delayed by ITD samples for post-processing the channel signal m.

Then, in step 817', the time envelope of the channel signal m is recovered using the delayed and weighted mono time envelope.

If in step 813' the result is that the ITD is not smaller than 0, i.e. ITD≥0 (this includes the case ITD>0, i.e. downmix signal is delayed with regard to the channel signal m, and the case ITD=0, i.e. no delay between the two signals), then the method proceeds (no) with step 821'.

Then, in step 821', the time envelope of the channel signal is recovered using the weighted mono time envelope without delay.

With regard to alternative embodiments, the considerations given with regard to FIG. 21 equally apply to FIG. 22.

In a further alternative embodiment for step 805' (channel transient evaluation), one of the channel signals is used as reference signal. In this case, only M−1 channel transient classification indications are required for deciding whether to post-process the M channel signals. For the decision, whether to post-process the reference channel signal or not, the same or a similar method as described for the stereo coding (based on FIGS. 5 and 8) can be used.

In another alternative embodiment, the overall downmix signal is formed by a number of downmix signals superior or equal to 1 and inferior to M. In that case, the reference signal can be one of the downmix signals and the downmix transient indication indicating whether the downmix signal is transient or not is associated with this downmix signal.

Referring to FIGS. 18, 19 and 22, the multi-channel audio encoding and decoding can be performed as follows.

First, at the encoder (see FIG. 19) the downmix signal is generated from the plurality M of channel signals $C_1$ to $C_M$, (corresponding to reference signs 315' and 317') forming the multi-channel signal, and used as input to the downmix encoder 307'. There is a transient detection model in the downmix encoder. If the downmix signal 319' is classified as downmix transient, a time envelope 323' of the downmix signal will be extracted by the downmix encoder 307' and transmitted to the decoder.

CLDs are extracted by the extractor 309' from the multi-channel signal by using the following equation.

$$CLD_m[b] = 10\log_{10}\frac{\sum_{k=k_b}^{k_{b+1}-1} X_{ref}[k]X_{ref}^*[k]}{\sum_{k=k_b}^{k_{b+1}-1} X_m[k]X_m^*[k]}, \quad (1)$$

wherein k is the index of frequency bin, b is the index of frequency band, $k_b$ is the start bin of band b, and $X_{ref}$ is the spectrum of the reference signal and $X_m$ are the spectrum of each channel of the multi-channel signal. The spectrum of the reference signal $X_{ref}$ can be either the spectrum of the downmix signal D 319' or the spectrum of one of the channel $X_m$ (for m in [1,M]).

Channel transient also needs to be detected. This kind of detection is, for example, based on $CLD_m$ monitoring and also performed by the extractor 309'. If a fast change, also referred to as attack, of $CLD_m$ between two consecutive frames is detected, the channel m is classified as channel transient.

Furthermore, for each channel m the interchannel time difference is calculated by the extractor 309' (representing the delay between the channel signal m and the downmix signal) from the multichannel signal based on the following equation $$ITD = \arg\max_d \{IC(d)\}$$

With IC(d) being the normalized cross-correlation defined as $$IC[d] = \frac{\sum_{n=0}^{N-1} x_1[n]x_2[n-d]}{\sqrt{\sum_{n=0}^{N-1} x_1^2[n] \sum_{n=0}^{N-1} x_2^2[n]}},$$

wherein $x_1$ represents the downmix signal and $x_2$ represents the channel signal m. In order to avoid a false detection of ITD, the maximum correlation may be compared with a threshold. If the maximum correlation is higher than the threshold, the detected delay corresponds to the ITD. Otherwise, the detected delay may not represent an ITD, to avoid introducing a wrong ITD, its value is changed to 0.

At the decoder (see FIG. 18) the multi-channel signal can be reconstructed by using the decoded downmix signal and the multi-channel parameters associated to the downmix signal.

If the received classification from the decoded downmix signal is downmix transient, embodiments of the invention use an additional processing module to improve the quality of the transient multi-channel signals.

The weighting factor applied to the downmix time envelope of the downmix signal is calculated by the decider 211' in following way. The first step is to calculate the average of $CLD_m$ $$acld_m = \frac{1}{N}\sum_{b=0}^{b=N} CLD_m[b]. \quad (2)$$

The second step is to calculate $$c = 10^{\frac{acld_m}{20}}. \quad (3)$$

In the last step, the weighting factor of channel m is calculated by $$a_m = \frac{2}{1+c} \quad (4)$$

Before applying the time envelope coming from the downmix decoding process to the channel m, this time envelope is first multiplied by the corresponding weighting factor $a_m$.

The determination, whether a channel m is channel transient and whether it is delayed with regard to the time envelope of the downmix signal, the calculation of the channel specific weighting factor $a_m$, the generation of the channel specific weighted time envelope based on the time envelope of the downmix signal and the channel specific weighting factor $a_m$, the delaying of the weighted time envelope, and the post-processing of a channel signal based on the channel specific time envelope, as described for the multi-channel coding, can be performed for each channel or for only one or several of the plurality of channel signals and can be performed in parallel or serially.

Although, primarily embodiments have been described, wherein all of the M (or M−1 in case one channel signal is used as reference signal) channels of the multi-channel signal are channel transient classified, other embodiments of the encoder, the device and the decoder and the respective methods may be implemented such that only a subset of the M channel signals is encoded and decoded, or channel classified and post-processed. It should be noted that two channel signals of a multi-channel signal with M>2 channels may be processed like the left and right channel signal of a stereo signal, so that for these signals the embodiments for stereo processing, e.g. with stereo transient classification or channel transient classification, may be applied.

What is claimed is:

1. A device for post-processing at least one channel signal of a plurality of channel signals of a multi-channel signal, the at least one channel signal being generated from a decoded downmix signal by a low-bit-rate audio coding/decoding system, the device comprising:

a receiver for receiving the at least one channel signal generated from the decoded downmix signal, a time envelope of the decoded down mix signal, an interchannel time difference between the at least one channel signal and the downmix signal, and a classification indication indicating a transient type of the downmix signal;

a post-processor for post-processing the at least one channel signal based on the time envelope of the decoded downmix signal weighted by a respective weighting factor and in dependence on the classification indication and the interchannel time difference, wherein the respective weighting factor depends on a received channel level difference, CLDm, between the at least one channel signal and a reference signal; and a decider adapted to decide dependent on the classification indication indicating a transient type of the downmix signal and on a further classification indication indicating a transient type of the channel signal, whether the at least one of the plurality of channel signals is post-processed, and to decide dependent on the interchannel time difference, whether the at least one channel signal is post-processed by a delayed time envelope of the downmix signal weighted by the respective weighting factor.

2. The device of claim 1, wherein the receiver is adapted to receive the plurality of channel signals and a plurality of interchannel time differences, wherein each of the interchannel time differences is associated to a channel signal of the plurality of channel signals and comprises information about a time difference between the respective channel signal and the downmix signal; and wherein the decider is adapted to control the post-processor.

3. The device of claim 1, wherein the decider is configured to control the post-processor to post-process the at least one channel signal using a delayed time envelope of the downmix signal weighted by the respective weighting factor in case the classification indication indicates that the downmix signal is downmix transient and the further classification indication associated to the at least one multi-channel signal indicates that the at least one channel is not channel transient, and the channel specific interchannel time difference associated to the at least one multi-channel signal indicates that the at least one channel signal is delayed with regard to the downmix signal.

4. The device of claim 1, wherein the decider is configured to control the post-processor to not post-process the at least one channel signal in case the classification indication indicates that the downmix signal is downmix transient and the further classification indication associated to the at least one multi-channel signal indicates that the at least one channel is channel transient.

5. The device of claim 1, wherein the classification indication indicates that a channel is channel transient in case a change over time of a relation between an energy of the channel signal and an energy of a reference signal exceeds a predetermined threshold.

6. The device of claim 5, wherein the downmix signal forms the reference signal.

7. The device of claim 1, wherein the classification indicates that the downmix signal is downmix transient in case a change over time of an energy of the downmix signal exceeds a predetermined threshold.

8. The device of claim 1, wherein the decider is adapted for deciding based on the interchannel time difference, whether the at least one channel signal is delayed with regard to the downmix signal, and, if the at least one channel signal is delayed with regard to the downmix signal, to delay the time envelope of the downmix signal to obtain a delayed time envelope for post-processing the delayed channel signal, wherein the decider is adapted to delay the time envelope of the downmix signal by the interchannel time difference.

9. A decoder for parametric multi-channel audio decoding, the decoder comprising a downmix decoder, an upmixer and a device comprising:

a receiver for receiving at least one channel signal generated from a decoded downmix signal by the decoder, a time envelope of the decoded downmix signal, an interchannel time difference between the at least one channel signal and the downmix signal, and a classification indication indicating a transient type of the downmix signal;

a post-processor for post-processing the at least one channel signal based on the time envelope of the decoded downmix signal weighted by a respective weighting factor and in dependence on the classification indication and the interchannel time difference, wherein the respective weighting factor depends on a received channel level difference, CLDm, between the at least one channel signal and a reference signal, and wherein the downmix decoder is configured to receive an encoded downmix signal representing the multi-channel signal and to decode the encoded downmix signal to generate the decoded downmix signal, wherein the upmixer is configured to receive the decoded downmix signal from the downmix decoder and multi-channel parameters associated to the downmix signal and to upmix the decoded downmix signal based on the multi-channel parameters to generate the plurality of channel signals of the multi-channel signal; and a decider adapted to decide dependent on the classification indication indicating a transient type of the downmix signal and on a further classification indication indicating a transient type of the channel signal, whether the at least one channel signal is post-processed, and to decide dependent on the interchannel time difference, whether the at least one channel signal is post-processed by a delayed time envelope of the downmix signal weighted by the respective weighting factor.

10. A method for post-processing at least one channel signal of a plurality of channel signals of a multi-channel signal, the at least one channel signal being generated from a decoded downmix signal by a low-bit-rate audio coding/decoding system, the method comprising the following steps:

receiving the at least one channel signal generated from the decoded downmix signal, a time envelope of the decoded downmix signal, an interchannel time difference between the at least one channel signal and the downmix signal, and a classification indication indicating a transient type of the downmix signal;

deciding dependent on the classification indication indicating a transient type of the downmix signal and on a further classification indication indicating a transient type of the channel signal, which one or ones of the plurality of channel signals are post-processed, and deciding dependent on the interchannel time difference, whether the at least one channel signal is post-processed by a delayed time envelope of the downmix signal weighted by a respective weighting factor; and post-processing the at least one channel signal based on the time envelope of the decoded downmix signal weighted by the respective weighting factor and in dependence on the classification indication and the interchannel time difference, wherein the respective weighting factor depends on a received channel level difference, CLDm, between the at least one channel signal and a reference signal.

11. A device for post-processing at least one of a left or a right channel signal of a stereo signal, the left and the right channel signals being generated from a decoded downmix signal by a low-bit-rate coding/decoding system, the device comprising:

a receiver for receiving the left channel signal and the right channel signal generated from the decoded downmix signal, a time envelope of the decoded downmix signal, an interchannel time difference between the left channel signal and the right channel signal of the stereo signal and a classification indication indicating a transient type of the downmix signal or of the stereo signal, a post-processor for post-processing at least one of the left or right channel signals based on the time envelope of the decoded downmix signal weighted by a respective weighting factor and in dependence on the interchannel time difference and on the classification indication, wherein the respective weighting factor depends on a received channel level difference, CLD, of the left and the right channel of the stereo signal, and a decider adapted to decide dependent on the classification indication indicating a transient type of the downmix signal and on a further classification indication indicating a transient type of the stereo signal, which one or ones of the channel signals are post-processed, and to decide dependent on the interchannel time difference, whether the left or right channel signal is post-processed by a delayed time envelope of the downmix signal weighted by the respective weighting factor.

12. The device of claim 11, wherein the decider is adapted to decide based on the interchannel time difference, whether one of the left channel signal and the right channel signal of the stereo signal is delayed with regard to the other channel signal, and, if one of the left channel signal or the right channel signal of the stereo signal is delayed with regard to the other channel signal, to post-process the delayed channel signal of the stereo signal using the delayed time envelope of the decoded downmix signal weighted by the respective weighting factor, and to post-process the other not delayed channel signal using the time envelope of the decoded downmix signal weighted by a respective weighting factor.

13. A method for post-processing at least one of a left or a right channel signal of a stereo signal, the left and the right channel signal generated from a decoded downmix signal by a low-bit-rate coding/decoding system, the method comprising:

receiving the left channel signal and the right channel signal generated from the decoded downmix signal, a time envelope of the decoded downmix signal, an interchannel time difference between the left channel signal and the right channel signal of the stereo signal and a classification indication indicating a transient type of the downmix signal or of the stereo signal;

deciding dependent on the classification indication indicating a transient type of the downmix signal and on a further classification indication indicating a transient type of the stereo signal, which one or ones of the channel signals are post-processed, and deciding dependent on the interchannel time difference, whether the left or right channel signal is post-processed by a delayed time envelope of the downmix signal weighted by a respective weighting factor; and post-processing at least one of the left or right channel signals based on the time envelope of the decoded downmix signal weighted by the respective weighting factor and in dependence on the interchannel time difference and on the classification indication, wherein the respective weighting factor depends on a received channel level difference, CLD, of the left and the right channel of the stereo signal.

* * * * *